United States Patent [19]

Clement et al.

[11] 4,038,895

[45] Aug. 2, 1977

[54] BREATH PRESSURE ACTUATED ELECTRONIC MUSICAL INSTRUMENT

[75] Inventors: Carl Jennings Clement, Los Altos; Kenneth Strong Campbell, Palo Alto; James Terrell Walker, Stanford, all of Calif.

[73] Assignee: Clement Laboratories, Mountain View, Calif.

[21] Appl. No.: 702,124

[22] Filed: July 2, 1976

[51] Int. Cl.[2] ..... G10H 1/00

[52] U.S. Cl. ..... 84/1.01; 84/1.27

[58] Field of Search ..... 84/1.01, 1.03, 1.09, 84/1.1, 1.24, 1.26, 1.27

[56] References Cited

U.S. PATENT DOCUMENTS

| | | | |
|---|---|---|---|
| 3,166,622 | 1/1965 | Neustadt | 84/1.01 |
| 3,318,991 | 5/1967 | Cookerly et al. | 84/1.1 |
| 3,439,106 | 4/1969 | Goodale | 84/1.27 |
| 3,483,304 | 12/1969 | Jenny | 84/1.27 |

*Primary Examiner*—Robert K. Schaefer
*Assistant Examiner*—Vit W. Miska
*Attorney, Agent, or Firm*—Flehr, Hohbach, Test, Albritton & Herbert

[57] ABSTRACT

A musical instrument having a general body outline similar to that of a saxaphone. A front key panel having a plurality of keys mounted thereon is located for easy fingering access to the keys which are in the same general location as the fingering keys on a saxaphone. A rear control panel is provided for mounting instrument voice characteristic and special effects controls. A mouthpiece is provided for engagement by a player's mouth and a pressure transducer is carried in the mouthpiece for communication with the player's breath pressure and for producing a pressure signal corresponding thereto. The pressure signal is connected to a pressure attack circuit for producing a pressure attack signal. Finger pressure applied to predetermined combinations of keys provides predetermined combinations of key pulses for connection to a key decoder. The key decoder produces a binary output corresponding to the predetermined combinations of key pulses which ranges from zero to 1111. A digital to analog converter receives the digital signal and provides an analog tone signal corresponding thereto which is connected to the input of an exponential voltage controlled oscillator. The voltage controlled oscillator provides a tone frequency in a predetermined band which is related exponentially to the tone signal. The tone frequency is divided and shaped to obtain an audio frequency which is connected to the input of a variable harmonic control filter which provides an audio frequency output having a given proportion of harmonics for a given setting at any audio frequency in the instrument range band. The harmonic controlled audio frequency is connected to a format filter for providing a voice frequency having wave shape characteristics similar to those of a predetermined voice. A variable gain amplifier receives the voice frequency at the input thereof. The pressure signal and the pressure attack signal are connected to control the variable gain amplifier for producing an instrument voice output which is interrupted and reinitiated each time the pressure signal falls below and thereafter rises above the pressure attack circuit threshold. Circuits are provided for the production of attack signals as a result of key changes. Means are provided for extensive modification of the audio signal through the action of any of several effect circuits controllable by any of several transducers.

34 Claims, 30 Drawing Figures

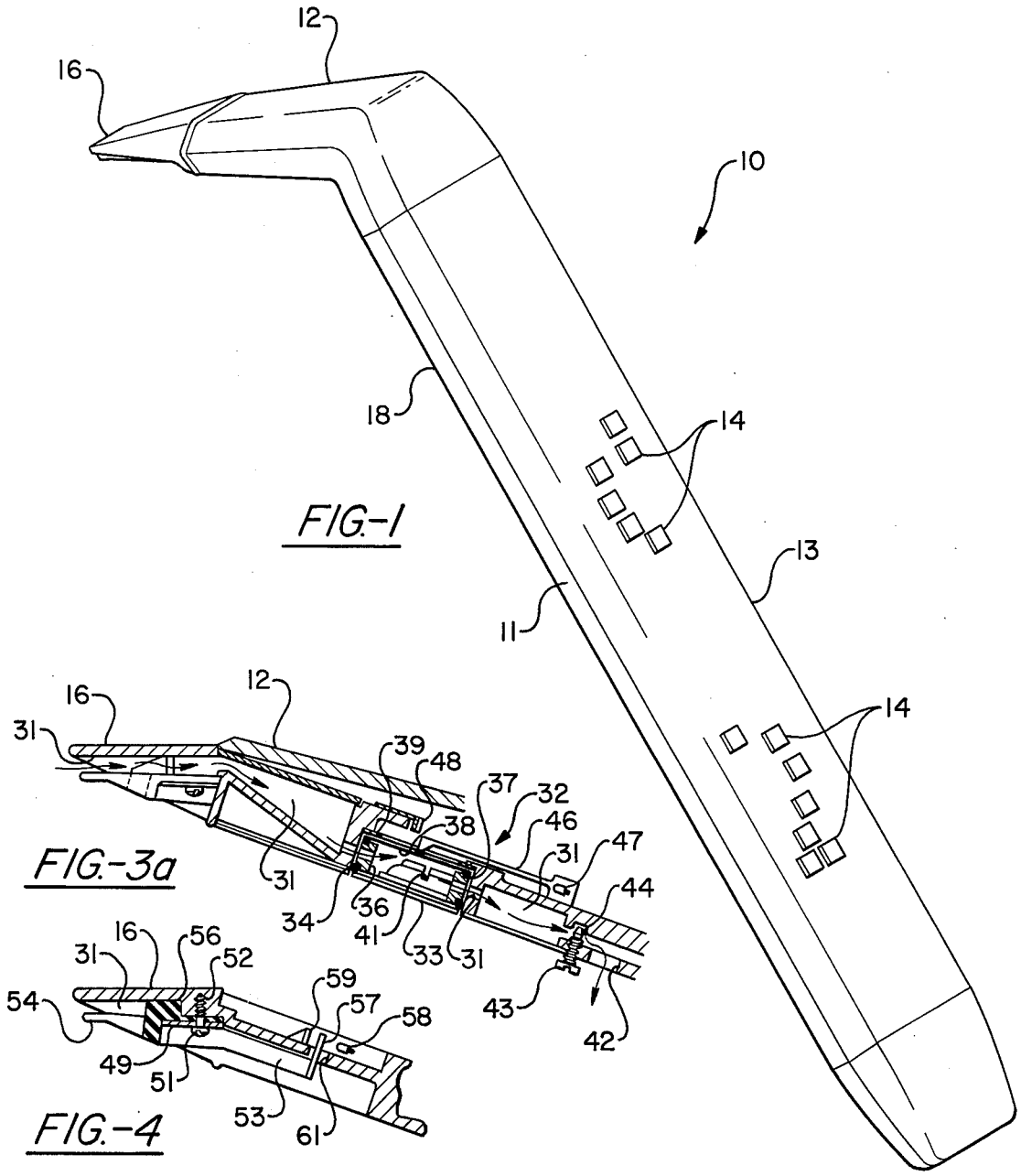
FIG.-1
FIG.-3a
FIG.-4
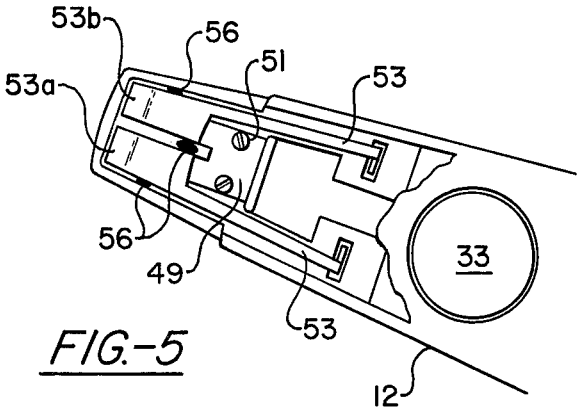
FIG.-5

IN
OUT

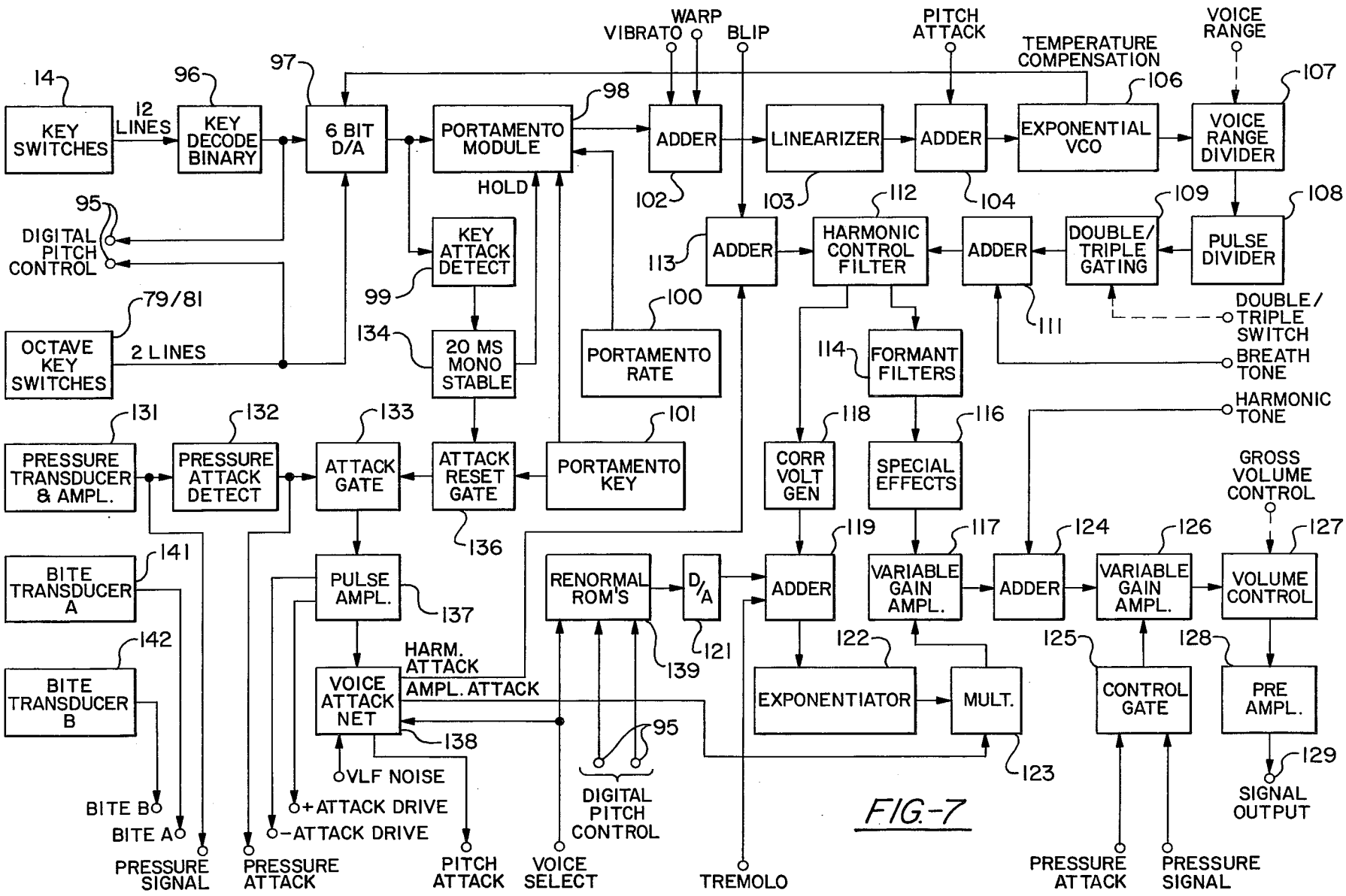
VOICE RANGE
VOICE RANGE DIVIDER
PULSE DIVIDER
DOUBLE/ TRIPLE SWITCH
BREATH TONE
HARMONIC TONE
GROSS VOLUME CONTROL
VOLUME CONTROL
PRE AMPL.
SIGNAL OUTPUT
TEMPERATURE COMPENSATION
EXPONENTIAL VCO
DOUBLE/ TRIPLE GATING
VARIABLE GAIN AMPL.
CONTROL GATE
PRESSURE SIGNAL
PRESSURE ATTACK
PITCH ATTACK
ADDER
ADDER
ADDER
ADDER
MULT.
LINEARIZER
HARMONIC CONTROL FILTER
FORMANT FILTERS
SPECIAL EFFECTS
VARIABLE GAIN AMPL.
EXPONENTIATOR
CORR VOLT GEN
ADDER
BLIP
WARP
VIBRATO
ADDER
ADDER
PORTAMENTO RATE
PORTAMENTO KEY
D/A
RENORMAL ROM'S
TREMOLO
DIGITAL PITCH CONTROL
VOICE SELECT
PORTAMENTO MODULE
HOLD
KEY ATTACK DETECT
20 MS MONO STABLE
ATTACK RESET GATE
HARM. ATTACK
AMPL. ATTACK
PITCH ATTACK
6 BIT D/A
ATTACK GATE
PULSE AMPL.
VOICE ATTACK NET
VLF NOISE
+ATTACK DRIVE
-ATTACK DRIVE
PRESSURE ATTACK
KEY DECODE BINARY
PRESSURE ATTACK DETECT
12 LINES
DIGITAL PITCH CONTROL
79/81
2 LINES
KEY SWITCHES
OCTAVE KEY SWITCHES
PRESSURE TRANSDUCER & AMPL.
BITE TRANSDUCER A
BITE TRANSDUCER B
BITE B
BITE A
PRESSURE SIGNAL
FIG-7

| NOTE | SWITCH | | | | | | | | | | | | OUTPUT CODE | | | |
|---|---|---|---|---|---|---|---|---|---|---|---|---|---|---|---|---|
| | H | J | K | L | M | N | P | R | S | T | V | W | 1 | 2 | 3 | 4 |
| D# | Φ | Φ | Φ | Φ | Φ | Φ | Φ | Φ | Φ | 1 | Φ | 0 | 1 | 1 | 1 | 1 |
| D | Φ | Φ | Φ | Φ | Φ | Φ | Φ | Φ | Φ | 1 | 0 | 1 | 1 | 1 | 1 | 0 |
| OPEN NOTE C# | Φ | Φ | Φ | Φ | Φ | Φ | Φ | Φ | 1 | 1 | 1 | 1 | 1 | 1 | 0 | 1 |
| C | Φ | Φ | Φ | Φ | Φ | Φ | Φ | Φ | 0 | 1 | 1 | 1 | 1 | 1 | 0 | 0 |
| B | Φ | Φ | Φ | Φ | Φ | 1 | Φ | Φ | 1 | 0 | Φ | Φ | 1 | 0 | 1 | 1 |
| A# | Φ | Φ | Φ | Φ | Φ | 0 | Φ | Φ | 1 | 0 | Φ | Φ | 1 | 0 | 1 | 0 |
| A | Φ | Φ | Φ | Φ | Φ | Φ | Φ | 1 | 0 | 0 | Φ | Φ | 1 | 0 | 0 | 1 |
| G# | Φ | Φ | Φ | Φ | Φ | Φ | 0 | 0 | 0 | 0 | Φ | Φ | 1 | 0 | 0 | 0 |
| G | Φ | Φ | Φ | Φ | 1 | 1 | 1 | 0 | 0 | 0 | Φ | Φ | 0 | 1 | 1 | 1 |
| F# | Φ | Φ | Φ | Φ | 0 | 1 | 1 | 0 | 0 | 0 | Φ | Φ | 0 | 1 | 1 | 0 |
| F | Φ | Φ | Φ | Φ | 1 | 0 | 1 | 0 | 0 | 0 | Φ | Φ | 0 | 1 | 0 | 1 |
| E | Φ | Φ | Φ | 1 | 0 | 0 | 1 | 0 | 0 | 0 | Φ | Φ | 0 | 1 | 0 | 0 |
| D# | 1 | 1 | 0 | 0 | 0 | 0 | 1 | 0 | 0 | 0 | Φ | Φ | 0 | 0 | 1 | 1 |
| D | 1 | 1 | 1 | 0 | 0 | 0 | 1 | 0 | 0 | 0 | Φ | Φ | 0 | 0 | 1 | 0 |
| C# | 1 | 0 | Φ | 0 | 0 | 0 | 1 | 0 | 0 | 0 | Φ | Φ | 0 | 0 | 0 | 1 |
| C | 0 | Φ | Φ | 0 | 0 | 0 | 1 | 0 | 0 | 0 | Φ | Φ | 0 | 0 | 0 | 0 |
GOES TO VCO D/A CONVERTER
OPEN 1 INDICATES SWITCH IS UP (OPEN)
0 " " " DOWN (CLOSED)
Φ " " " " OR UP WITHOUT AFFECTING OUTPUT CODE
FIG.-12
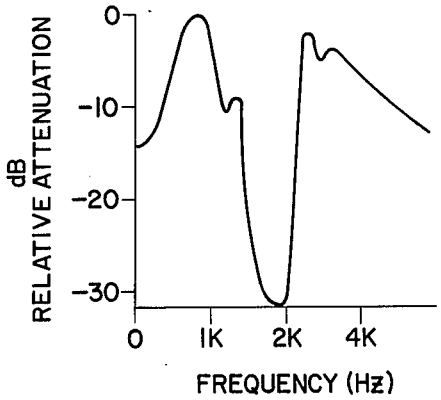
FIG.-10
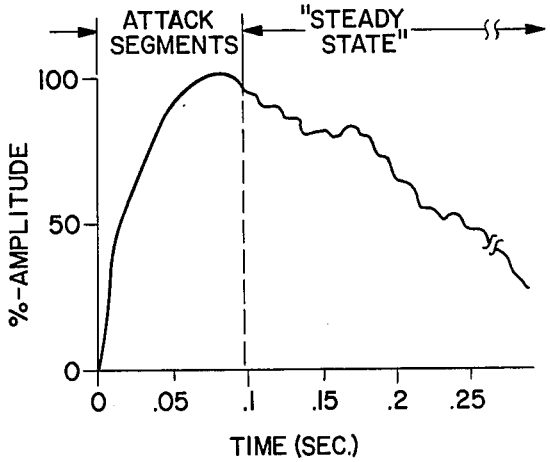
FIG.-11

-V
R71
R72
C12
R108
106
+V
R73
C15
A28
R74
R44
C17
C16
-V
$I_{C1}$
$I_{C2}$
R75
103
R100
D12
R104
R105
R101
D13
R103
R106
R102
6
R107
Q13
Q14
R76
R79
R78
Q15
R77
R80
$I_{C3}$
R91
C18
R92
R90
A29
R93
C13
C14
8
C21
D8
D9
R99
R97
R95
D10
Q16
Q17
A30
D11
9
C19
R98
R96
C20
$+V_1$

12
R117
A46
+V
Q18
R118
Q19
C22
R119
-V
A46
R120
C23
Q20
R121
Q21
R122
-V
R123
C25
R124
Q22
Q25
A48
R126
R127
-V
R47
R128
C26
Q24
R125
Q25
R130
R129
C27
13
R133
R132
Q26
C28
10
R131
+V1
C31
R135
Q31
R140
R136
D15
-V
14
C29
Q27
R137
R138
R139
C30
Q29
Q30
R143
Q28
D28
R141
D14
C32
R142
HARMONIC CONTROL BUS
A49
C77
R144
D16
R240
R145
Q32
C33
D29
C34
R147
C35
Q34
R148
R149
D18
D17
R146
Q33
R151
15
Q35
R152
C36
R150

71
R193
C55
R194
R254
R195
Q42
+V
R196
C56
R197
R198
Q43
R255
R256
R199
R201
A70
C57
-V
A65
BLIP
R204
R258
Q44
R206
A69
C60
A67
A66
C58
R202
R203
R205
A68
C59
R164
R165
R257
Q38
R200
C48
17
126
R167
R166
C49
R168
R169
25
18
127
128
C42
C41
C40
C44
R158
C43
R157
19
C45

BREATH PRESSURE ACTUATED ELECTRONIC MUSICAL INSTRUMENT

BACKGROUND OF THE INVENTION

This invention relates in general to an electronic musical instrument and more particularly to such a musical instrument which is operated by a player's breath pressure and finger manipulation to realistically reproduce either the sound of well known conventional musical instruments or unique instruments voices.

Conventional woodwind or reed musical instruments require special breath development generally obtained only over long periods of time as a result of intensive practice before reasonably high degrees of skill are developed in operating the instrument. Thereafter an exceptional "ear", or tone distinguishing capability is required to maintain a true pitch in playing a given note on woodwind instruments. Fingering in these instruments is multiple and generally difficult as the position of the fingering keys is dictated by the physical requirements of size and shape of the resonant air column within the instrument body. Moreover, any given woodwind instrument speaks with only one voice which is unalterable. Special effects or qualities may be injected by a player into the one voice, but only after extensive practice with the instrument over long periods of time. A musical instrument is desirable which will allow these special effects to be injected into an instrument voice without undue practice for prolonged periods of time, and which "speaks" in more than one preselected voice.

SUMMARY AND OBJECTS OF THE INVENTION

A breath pressure actuated electronic musical instrument is disclosed which is operated by exertion of finger pressure by a player on predetermined combinations from among a plurality of fingering keys and by simultaneous exertion of breath pressure by the player. There is an instrument body, a mouthpiece attached to the instrument body which is formed to be received in the player's mouth, and a key panel attached to the instrument body for mounting the plurality of fingering keys. Each of the fingering keys produces a key pulse when depressed by the player's fingers. A key decoder receives the key pulses in predetermined combinations and produces a digital output which corresponds to the predetermined combination. A digital to analog converter is provided for converting the digital output to a pitch control voltage or tone signal having a predetermined value in accordance with the magnitude of the number represented by the digital output. An exponential voltage control oscillator is provided for receiving the pitch control voltage and for producing a tone frequency fundamental with a predetermined number of harmonic components which is exponentially related to the pitch control voltage. The exponential voltage controlled oscillator includes means for sensing the temperature within the exponential voltage controlled oscillator and for providing a reference signal related thereto. The reference signal is connected to the digital to analog converter for adjusting the pitch control voltage to drive the tone frequency to the predetermined value in spite of errors induced by temperature. A formant filter has an input which is coupled to the output of the exponential voltage controlled oscillator. The formant filter provides a voice frequency output which includes those frequencies associated with a predetermined voice. A pressure transducer is mounted in the mouthpiece for providing a pressure signal responsive to breath pressure imparted to the mouthpiece by the player. A variable gain amplifier is coupled to receive the output from the formant filter and the pressure transducer so that simultaneous fingering of a predetermined combination of said plurality of keys and application of breath pressure by the player produces an instrument voice output from the variable gain amplifier having a predetermined pitch and a wave shape similar to that associated with the predetermined voice.

In general it is an object of the present invention to provide an electronic musical instrument which does not require unusual breath capability development for skillful operation of the instrument.

Another object of the invention is to provide an electronic musical instrument which is capable of presenting any one of several preprogrammed voices.

Another object of the present invention is to provide an electronic musical instrument having a wide range of expressive effects.

Another object of the present invention is to provide an electronic musical instrument in which the attack portion of the notes may be altered by a player of only moderate experience.

Another object of the present invention is to provide an electronic musical instrument having a wide tuning capability.

Another object of the present invention is to provide an electronic musical instrument on which the same fingering sequences are retained for note sequences in different keys.

Additional objects and features of the invention will appear from the following description in which the preferred embodiment has been set forth in detail in conjunction with the accompanying drawings.

BRIEF DESCRIPTION OF THE DRAWINGS

FIG. 1 is an isometric view of an electronic musical instrument constructed in accordance with the invention disclosed herein.

FIG 3*a* is a partial sectional side elevation view along part of the line 3—3 at the mouthpiece end of FIG. 3.

FIG. 4 is a sectional side elevation view along the line 4—4 of FIG. 2.

FIG. 5 is a view along the line 5-5 of FIG. 3.

FIG. 7 is a block diagram of the electronic musical instrument.

FIG. 10 is a graph showing a formant filter response for an oboe voice.

FIG. 11 is a graph showing a time envelope for the attack portion of an oboe voice.

FIG. 12 is a chart showing predetermined key combinations corresponding to predetermined musical notes and binary output resulting therefrom.

DESCRIPTION OF THE PREFERRED EMBODIMENT

Figures 2, 3, 6:
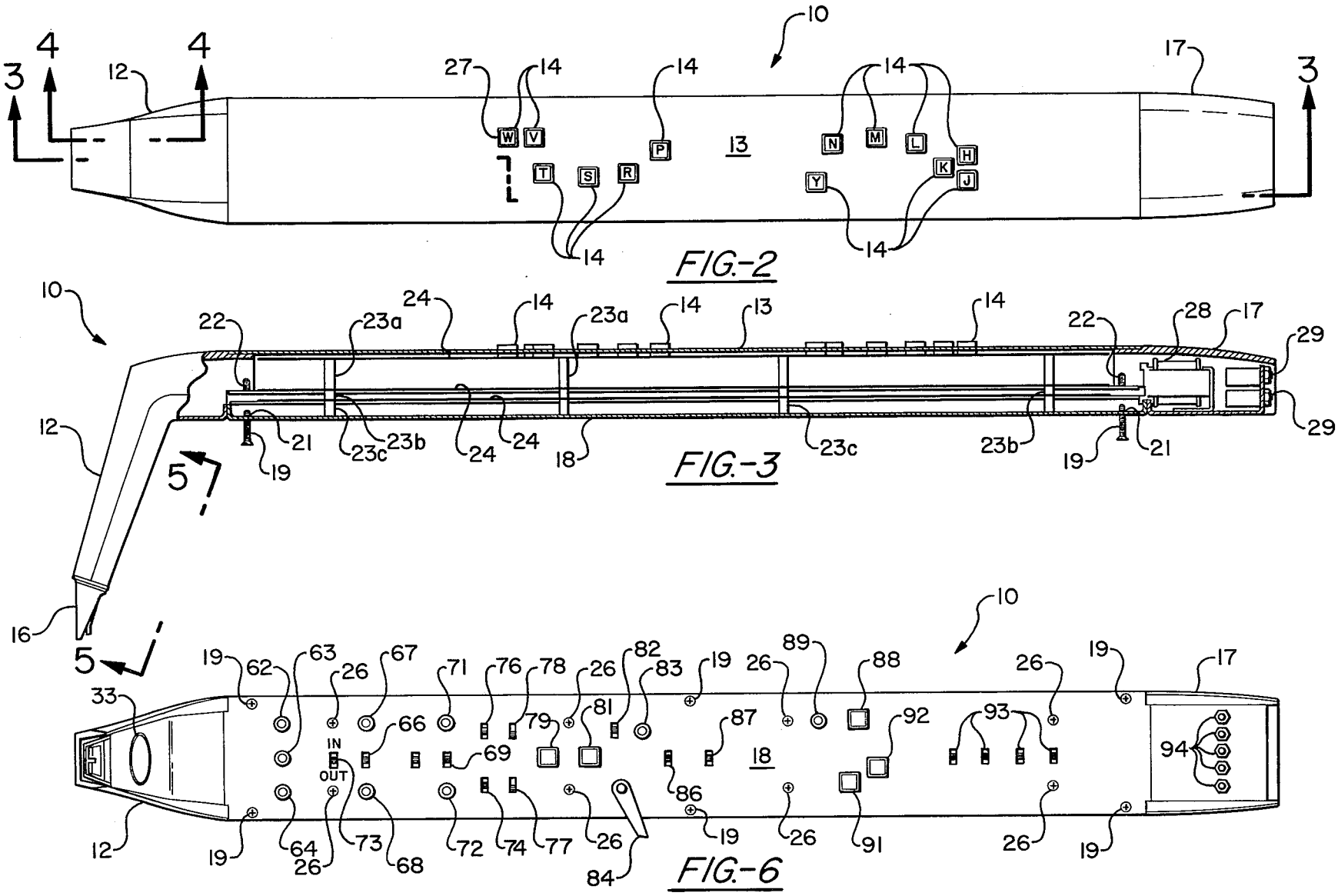
FIG. 2 is a plan view of the front key panel of the instrument of FIG. 1.
FIG. 3 is a sectional side elevation view along the line 3—3 of FIG. 2.
FIG. 6 is a plan view of the back control panel of the instrument of FIG. 1.

Referring to FIG. 1 an isometric view of the physical outline of the preferred embodiment is shown. The preferred embodiment of the electronic musical instrument takes the form of a hand held "horn" 10 having a "horn" or instrument body 11 with a mouthpiece 12 attached at the upper end thereof. A front panel 13 is shown having a plurality of keys 14 extending therethrough for easy access by the fingers of a player. Mouthpiece 12 has an accessible end 16 adapted to fit in a player's mouth.

Turning now to FIG. 2, the orientation of keys 14 on front panel 13 is shown. As mentioned above, keys P, R, F, T, V and W are placed for easy access by the left hand of a player. The keys J, H, K, L, M, N, and sharp (Y in FIG. 2) are arranged for easy access by the fingers on the right hand of a player. A transformer housing 17 is shown on the end of the instrument body opposite from the end to which mouth-piece 12 is attached.

The sectional view of FIG. 3 shows the "horn" 10 having a rear control panel 18 which is attached to a framework including front panel 13 by means of screws 19 passing through holes 21 in rear panel 18 and the framework for engagement with threaded holes 22 in mouthpiece 12 and transformer housing 17. Four standoff assemblies 23 are shown attached to the inside of rear control panel 18 for supporting three elongate circuit boards 24 in spaced relation inside instrument body 11. Standoff assemblies 23 contain three sections 23a, 23b and 23c in this embodiment, which are held together and mounted on rear control panel 18 by means of screws 26. It may be seen that the circuit board 24 mounted on the outer end of standoff 23a is utilized for mounting keys 14 which, when assembled, each extend through a square aperture 27 in front panel 13 for providing the forementioned fingering access. Keys 14 are pressure sensitive switches, which, in the simplest embodiment, are normally open and are therefore closed by pressure exerted on the top of the key 14.

A transformer 28 is seen mounted inside transformer housing 17. Transformer housing 17 is also utilized for mounting a plurality of externally accessible output jacks 29 for providing such functions as signal output and power input access, headphone output, foot pedal control, etc. Transformer 28 is used for producing proper voltages for use in powering the circuitry hereinafter disclosed from a 120VAC power line.

Mouthpiece 12 attached to one end of instrument body 11 has a channel 31 therethrough for transmitting breath pressure from the accessible end 16 to a pressure transducer shown generally at 32. Pressure transducer 32 has a cover plate 33 on the under surface of mouthpiece 12 which is held in place by means of fasteners such as screws (not shown) for providing access to pressure transducer 32 for adjustment, repair, replacement, etc. An O-ring 34 is positioned immediately behind cover plate 33 for contact with a retaining ring 36 which bears against a depending flange 37 on diaphragm 38. A spacer ring 39 is positioned between diaphragm 38 and the structure of mouthpiece 12 for adjusting the diameter of diaphragm 38. Retaining ring 36 has a number of radial slots 41 therethrough so that pressure from channel 31 may be communicated uniformly with one side of diaphragm 38. One end of channel 31 is communicated with ambient pressure outside mouthpiece 12 through channel outlet 42. A threaded needle valve 43 is shown for engagement with a needle valve seat 44 for metering flow and back pressure through channel 31 to outlet 42.

The opposite side of diaphragm 38 from that side exposed to the pressure in channel 31 has one end of a light pipe 46 in contact therewith so that motion of the central portion of diaphragm 38 causes motion of the one end of light pipe 46. The other end of light pipe 46 has mounted adjacent thereto a light source such as light emitting diode 47. The light energy from light emitting diode 47 is transmitted through light pipe 46 to the end which moves with the center portion of diaphragm 38. A photosensitive device such as photodiode 48 is mounted in mouthpiece 12 so that a signal is generated therefrom which is related to the intensity of the light energies impinging thereupon from the one end of light pipe 46. In this manner the signal from photodiode 48 is related to the pressure exerted against the one side of diaphragm 38 which is in communication with channel 31. In this fashion a pressure signal is generated by photodiode 48 which is related to the pressure in channel 31. Since the accessible end 16 of mouthpiece 12 is adapted to fit in the mouth of the player, the player's breath pressure is communicated with diaphragm 38 to thereby produce a pressure signal from photodiode 48 which is related thereto.

Turning to FIG. 4, the arrangement for obtaining one of two bite signals is shown. A spring member 49 is mounted inside accessible end 16 by means of a fastener such as screw 51 engaging the threads in a threaded hole 52 in mouthpiece 12. A bite lever 53 has one end 54 which is accessible to the lower teeth or mouth portion of the player. Bite lever 53 is held in place in mouthpiece 12 by means of a resilient seal 56 seen in FIG. 5. Seal 56 isolates channel 31 from the remainder of the interior of mouthpiece 12. Pressure applied on one end 54 of bite lever 53 causes lever 53 to pivot about the point at which it contact spring member 49 so that a flag 57 on the other end of bite lever 53 moves in a manner to interfere with more or less of a beam of light energy from a light source such as light emitting diode 58. Light emitting diode 58 is positioned to cause light energy therefrom to impinge upon phototdiode 59 when flag 57 is removed from the path therebetween. Thus, it may be seen that bite pressure applied to end 54 causes flag 57 to depart from the path between light emitting diode 58 and photodiode 59 as bite lever 53 pivots about the point contacting spring member 49. Flag 57 extends through an aperture 61 in the structure of mouthpiece 12 so that light emitting diode 58 and photodiode 59 may be isolated from ambient light.

FIG. 5 shows that the structure of FIG. 4 described above is provided on each side of the underside of mouthpiece 12. A left bite lever 53a is shown together with a right bite lever **53*b*,** so that two bite lever signals may be generated independently by bite pressure from a player's mouth. The two signals are designated as bite signal A and bite signal B for purposes of discussion hereinafter.

FIG. 6 shows rear panel 18 and the relative positions of the various controls for the electronic musical instrument mounted for access thereon. A volume control 62 is provided for adjusting the amplitude of the signal output from the instrument. An octave closure control 63 is provided for adjusting the octave output of the instrument so that a precise two to one frequency ratio exists between the upper and lower instrument voice signals for two predetermined combinations of depressed keys 14 which provide voice frequencies one octave apart. A tuning range control 64 is provided for frequency adjustment of the instrument voice signal to obtain a designated fundamental in the instrument voice signal for a predetermined depression of keys 14. A three position switch 66 is provided to direct the signal from bite transducer A or bite transducer B to a frequency modulated (FM) or vibrato oscillator to be hereinafter described. A rate control 67 and an excursion control 68 are provided for the frequency modulated oscillator. Rate is defined as the period for one sweep cycle through the modulation band of frequencies for frequency modulation and of amplitude deviation for amplitude modulation. Excursion is defined as the width of the frequency modulation band in the context of frequency modulation, and as the magnitude of amplitude deviation in the context of amplitude modulation.

Another three position switch 69 is provided for selecting the signal from bite transducer A or bite transducer B, or no signal at all, to be transmitted to the input of an amplitude modulated (AM) or tremolo oscillator to be hereinafter described. A rate control 71 is provided along with an excursion control 72 for controlling the AM characteristics described in conjunction with the description of controls 67 and 68 above. Another three position switch 73 is provided which affords phase lock control between the outputs of the FM and AM oscillators. For the position locking the oscillators in phase the instrument voice signal is largest when the pitch is high. For the position locking the oscillators out of phase the instrument voice signal is largest when the pitch is low. The off of central position allows random phase relationship between the AM and FM oscillators.

A small frequency warp three position switch 74 is provided to select either A or B bite transducers or to omit the warp signal from the instrument voice signal. A special effects three position switch 76 is provided to select A or Bbite transducers for any of a miscellaneous group of special effects which may be included in the instrument circuitry. A two position octave doubling switch 77 is provided for on/off positioning, as is a two position switch 78 for on/off octave tripling. These two switches provide for the injection of special effects to be hereinafter described in the instrument voice signal. An up octave key 79 is provided together with a down octave key 81. An on/off breath tone key 82 is provided together with a breath tone intensity control 83. A lever transducer control 84 is provided for manual operation at the rear control panel 18. A wide frequency warp three position switch 86 is provided for selecting warp control by means of lever 84 or a foot pedal through one of the input jacks 29. Another three position switch 87 is provided for special effects selection at either lever 84 or a foot pedal through one of input jacks 29. Both switches 86 and 87 have a central off position.

A portamento key 88 is provided for selecting a portamento or slur effect between notes obtained by depression of predetermined combinations of keys 14. A portamento rate control 89 is available for adjusting the amount of time for the transition from one selected note to another or the rate of change of frequency of the instrument voice signal. An octave doubling key 91 is provided together with an octave tripling key 92 which are effective only when the octave doubling and octave tripling on/off switches 77 and 78 are selected on. A series of three position voice switches 93 are provided having a center off position and affording a separate voice for each combination of the extreme positions of switches 93. A series of output jacks 94 is provided for presenting zero to ten volt output signals for connection to allow control of a synthesizer.

Figure 9:
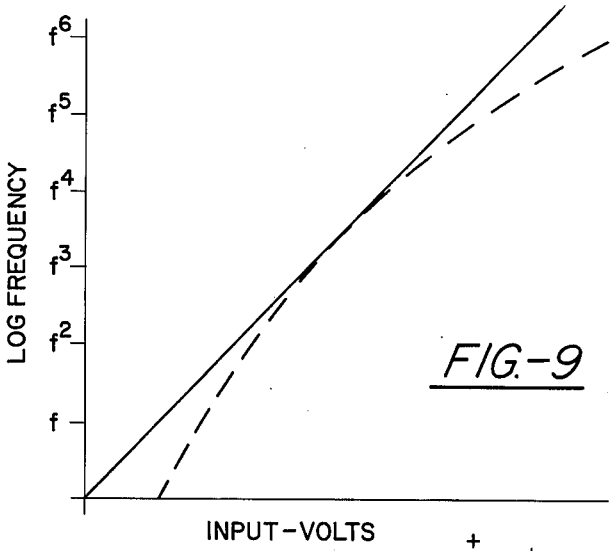
FIG. 9 is a graph showing log frequency as a function of control voltage.

Turning to the block diagram of FIG. 7 the key switches 14 are shown with twelve lines for transmitting the individual switch states to a binary key decoder 96. Decoder 96 produces a four bit binary output for transmission to a six bit digital to analog converter 97. Octave key switches 79 and 81 are shown with two lines for transmitting an octave up, octave down, or no signal to six bit digital to analog converter 97. A pair of output terminals 95 are provided upon which the six bit digital code defining an octave and a semitone is presented. Terminals 95 are labeled digital pitch control. The analog output from converter 97 is directed to a portamento module 98 and a key attack detector 99. A portamento rate control module 100 is set by rate control adjustment knob 89 for setting transition time for the slur effect as mentioned above. Portamento module 98 is actuated by a portamento key 101. When portamento key 101 is not depressed, the analog signal from converter 97 is connected directly to an adder 102 which also receives signal inputs labeled vibrato and warp. The summed signals are transmitted to a linearizer 103. The relationship between log frequency (tone frequency) as a function of input voltage (tone signal) is seen in FIG. 9. An adder 104 is provided for receiving a pitch attack signal in the linearizing signal, which when summed, is presented as a tone signal to the input of an exponential voltage controlled oscillator (VCO) 106. A temperature compensation signal is generated by exponential VCO 106 which is transmitted as a reference signal to six bit digital to analog converter 97, so that a tone frequency output is obtained from exponential VCO 106 which is independent of temperature variations therein. The tone frequency is received at the input to a voice range divider 107 which is controlled by the actuation of voice switches 93 for determining the voice frequency range. The output from voice range divider 107 is connected to a pulse divider 108 which, in this embodiment, performs a division by a factor of 32. Divider 108 therefore provides one pulse at the output thereof for every 32 input pulses. The frequency of these output pulses is an audio tone frequency for the instrument voice signal. The output from divider 108 is in the form of a constant duty cycle pulse (constant ratio of one signal state to the other signal state) transmitted to a double/triple gating circuit 109 which is controlled by the double/triple switches 77-91/78-92 respectively on rear control panel 18. The output of gating circuit 109 is transmitted to an adder 111 which also receives a breath tone signal controlled by switches 82 and 83 on rear control panel 18. The summed signal from adder 111 is transmitted to harmonic control filter 112. A "blip" signal is connected to an adder 113 which also receives a harmonic attack signal and produces a summed output received by harmonic control filter 112. Harmonic control filter 112 produces an output which has a response which is a function of the fundamental pitch frequency. The amplitude of the harmonics for any fundamental output frequency is controlled so that they are the same for any fundamental pitch frequency. The relative amplitudes of the harmonics for one pitch frequency and a different pitch frequency are therefore the same. Harmonic control filter 112 is sometimes referred to as a variable analog filter, the output of which is delivered to the input of a formant filter 114 which provides an output frequency response having the response characteristics of a predetermined voice. Such a response characteristic is seen in FIG. 10 for an oboe. A time envelope for the attack portion of an output frequency from formant filter 114 is seen in FIG. 11, and is also characteristic of an oboe. The formed voice frequency waveshape from formant filter 114 is delivered to any desirable special effects circuitry 116, and thereafter to a variable gain amplifier 117.

The harmonically controlled frequency output from filter 112 is connected to a correction voltage generator 118 having an output which is in turn connected to an adder 119. Adder 119 receives a signal from a digital to analog converter 121 which performs an adjustment to correct for amplitude losses in the formant filter. Adder 119 also receives tremolo and vibrato inputs, summing all of the inputs and producing a summed output delivered to an exponentiator 122. Exponentiator 112 provides for logarithmic gain control connected to a multiplier 123 which also receives an amplitude attack signal. The multiplied output from multiplier 123 is connected to variable gain amplifier 117 for producing an output to which is added an inharmonic tone at adder 124. The summed voltage from adder 124 is connected to the input of variable gain amplifier 126 which also receives a control signal from a control gate 125. Control gate 125 has a pressure attack signal and a pressure signal as control inputs. The output from variable gain amplifier 126 is the instrument voice signal which is treated by a gross volume control 127 which is manually adjusted. Gross volume control 127 regulates the signal to preamplifier 128 which provides the signal output from the electronic musical instrument at a terminal 129. Output terminal 129 is at one of the aforementioned jacks 29 described in conjunction with FIG. 3 above.

Pressure transducer 32 together with an associated amplifier is shown at block 131. The pressure signal is derived therefrom which is connected to control gate 127 as recited above, and also to a pressure attack detector 132. The pressure attack signal is provided from pressure attack detector 132 which is connected to control gate 127 as recited above, and also to attack gate 133. Key attack detector 99 produces an actuating pulse for a change in the tone signal analog output from digital to analog converter 97 which is equivalent to plus or minus one semitone or more. The actuating pulse from key attack detector 99 is connected to twenty millisecond monostable multivibrator 134 for producing a key pulse actuating an attack reset gate 136. Either the pulse from attack reset gate 136 or the pressure attack signal from pressure attack detector 132 actuates attack gate 133. Attack gate 133 produces an attack drive pulse which is amplified in pulse amplifier 137 and connected to a voice attack network 138. Voice attack network 138 produces the aforementioned pitch attack signal connected to adder 104, the aforementioned amplitude attack signal connected to multiplier 123 and the aforementioned harmonic attack signal connected to adder 113.

Figure 14:
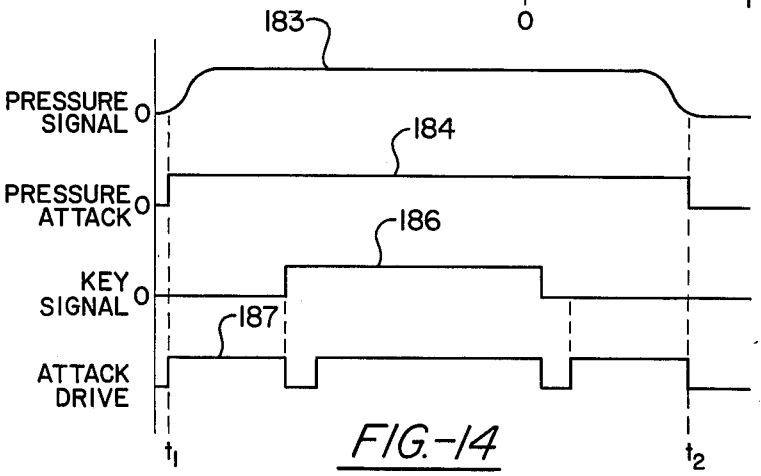
FIG. 14 is a timing diagram related to the transient attach drive signals in the disclosed circuit.

Referring to FIG. 14 a timing diagram shows the manner in which the attack drive is obtained. A pressure signal 183 being initiated at time $t_1$. Pressure signal 183 appears at the output to pressure transducer and amplifier 131. A pressure attack signal 184 appears at the output of pressure attack detector 132. In the presence of pressure signal 183 and pressure attack signal 184, when a key signal 186 is generated by depressing one of the keys 14, an attack drive signal 187 is generated, after the twenty millisecond hold period, through attack gates 136 and 133, appearing as the output from pulse amplifier 137. Attack drive terminates at time $t_2$ when pressure signal drops below the threshold of pressure transducer and amplifier 131.

Voice attack network 138 receives a very low frequency (VLF) noise signal to simulate the "zitterbewegung" ("zit" or random fluctuations) effect in the instrument voice signal. A voice select signal is also received at network 138. The voice select signal together with the digital pitch control signals at terminals 95 are connected to a renormalizer and audio gain control 139. Renormalizer 139 includes a read only memory (ROM) which provides a programmed digital output corresponding to the digital pitch control inputs at terminals 95. The programmed digital output is connected for conversion in digital to analog converter 121 to provide the analog output signal connected to adder 119 as described above.

FIG. 7 also shows a bite transducer A 141 and a bite transducer B 142 for producing bite signal A and bite signal B respectively as described above in conjunction with FIGS. 4 and 5.

Turning now to the block diagram of FIG. 8 the manner in which various of the signal inputs to the block diagram of FIG. 7 are obtained will now be described. An audio noise source 143 is amplified in an amplifier 144 and connected to the input of a low pass filter 146. The low frequency output from filter 146 is amplified in amplifier 147 to produce VFL or audio frequency noise connected to voice attack network 138 to obtain the "zit" effect as described above.

The output from amplifier 144 is also connected to a high pass filter 148 which provides a band of high frequencies at the input of a variable gain amplifier 149. A curve shaper 151 is provided which receives the pressure signal from pressure transducer and amplifier 131 and provides an output which is also connected to variable gain amplifier 149. Breath tone on/off switch 82 located on rear control panel 18 is provided in series with breath tone intensity control 83 for providing a breath tone output which is connected to adder 111 in FIG. 7 as described above.

Pressure signal from pressure transducer and amplifier 131 is also connected to adder 111 in FIG. 7 as described above.

Pressure signal from pressure transducer and amplifier 131 is also connected to a blip and inharmonic generator 152 which provides a blip output signal and an inharmonic tone output signal. The blip signal is connected to adder 113 as described in conjunction with FIG. 7 above and the inharmonic tone is connected to adder 124 as also described in conjunction with FIG. 7 above.

The bite A signal is connected through switch 86 to a level control 152 and thence to an adder 153. A level transducer 154 actuated by lever 84 produces an output which is also connected to adder 153. The summed signal from adder 153 is presented as the warp signal which is connected to adder 102 as seen in FIG. 7 above.

The bite A signal is also connected to a set of switches 156 which has connected hereto signals from a rate selector 157 and an excursion selector 158. Bite A signal is passed by switches 156 to a threshold detector 159 and an exponentiator 161. The output from threshold detector 159 is transmitted to gate logic 162 which also receives the negative attack drive signal from pulse amplifier 137 of FIG. 7. Gate logic 162 is connected to a current controlled oscillator 163 which also receives the output from exponentiator 161. Current controlled oscillator produces an output frequency which is connected to a variable gain amplifier 164 which is selected by switches 156. Variable gain amplifier 164 has connected thereto excursion control 158 through switches 156 for controlling the frequency excursion of the modulated frequency or vibrato output. Exponentiator 161 has connected thereto rate control 157 through switches 156 for controlling the period of the vibrato output. The vibrato output is connected to adder 102 in FIG. 7 as described above.

The bite B signal is connected to a set of switches 166 which has associated therewith a rate control 167 and an excursion control 168. The bite B signal is passed through switches 166 to a threshold detector 169 and an exponentiator 171. The output from threshold detector 169 is connected to gate logic 172 which is connected to a current controlled oscillator 173. The output from exponentiator 171 is also connected to current controlled oscillator 173 for producing an output connected to variable gain amplifier 174 which provides an amplitude modulated or tremolo output. Variable gain amplifier 174 has connected thereto excursion control 168 through switches 166 for controlling the amplitude excursion of the modulated amplitude or tremolo output. Exponentiator 171 has connected thereto rate control 167 through switches 166 for control of the period of the tremolo output.

A phase control 176 is provided which is actuated by switch 73 of FIG. 6 to provide in phase or out of phase relationships between the vibrato and tremolo outputs. It should be recognized in the foregoing that the switches 156 and 166 include switches 66 and 69 in FIG. 6, and that the rate and excursion controls 67/71 and 68/72 respectively are associated with the rate blocks 157/167 and the excursion blocks 158/168 of FIG. 8.

Figure 8:
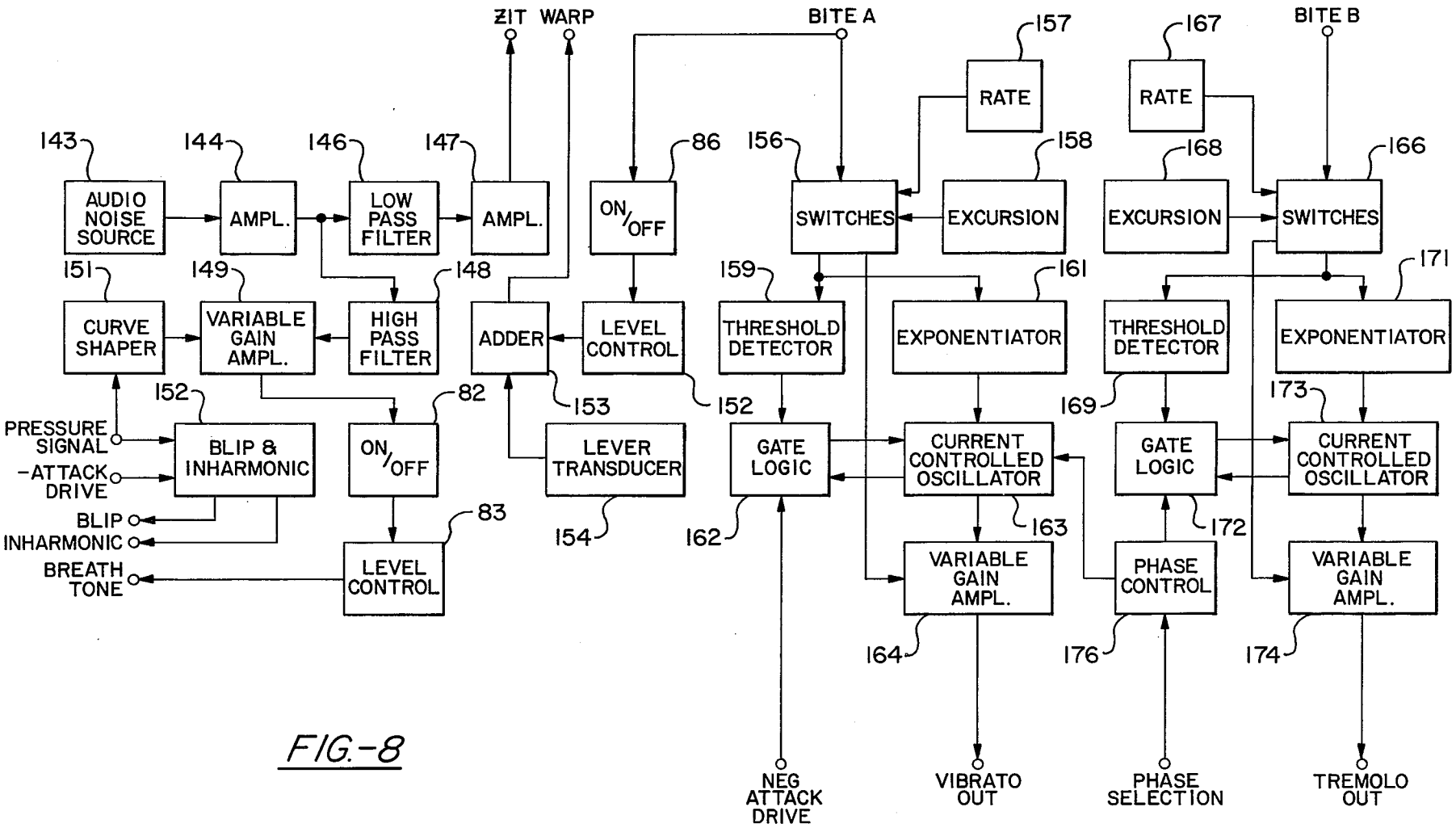
FIG. 8 is a block diagram supplementing the block diagram of FIG. 7.

In preparation for entering into a description of the schematic diagrams corresponding to the block diagrams of FIGS. 7 and 8 above, it should be confirmed that an octave exists between a frequency $F_0$ and another frequency which is equal to $2F_0$. There are twelve semitones in each octave which are equivalent to one half notes in the musical scale. It results that the $\sqrt[12]{2}$ is 1.0593. With a base frequency of $F_0$ the first semitone is therefore equivalent to 1.0593 $F_0$. If we term this new frequency $F_1$, the second semitone is equivalent to 1.0593 $F_1 = F_2$. The third semitone is 1.0593 $F_2$ and so on until we reach 1.0593 $F_{11}$ which is equivalent to $2F_0$. It is therefore seen that the frequency relationship as a function of semitone steps is logarithmic. This is explainable inasmuch as the ear is a logarithmic receiver, since it senses linear steps from logarithmic frequency inputs. This is the reason for the requirement for an exponential voltage controlled oscillator if uniform voltage steps are to be provided for controlling semitone output frequencies. Though there exists the aforementioned logarithmic relationship, the tone signal and the tone frequency will both be expressed in terms of semitone values for convenience in the following description.

It should further be observed that the normal eight note musical scale for "do" at the low end to "do" at the high end covers one octave. By our previous definition the low "do" is one frequency and the high "do" is twice that one frequency. Moreover, there are twelve semitones between the low and high "do" notes. There are two semitones between the notes "do" and "re", two semitones between the notes "re" and "mi" , one semitone between the note "mi" and the note "fa", two semitones between the notes "fa" and "sol", two semitones between the notes "sol" and "la", two semitones between the notes "la" and "ti", and one semitone between the note "ti" and the high "do" note. Since the binary key decoder 96 has a four bit digital output, it has a sixteen binary number capability. Reference is now made to FIG. 12 where the letter notes of the scale are set forth in the left hand vertical column, letter designations for the keys 14 as seen in FIG. 2 of the drawings are placed horizontally across the top of the cart and necessary depressed and nondepressed keys 14 are indicated in the body of the chart to produce the indicated binary output code in the vertical right hand column.

Figure 16:
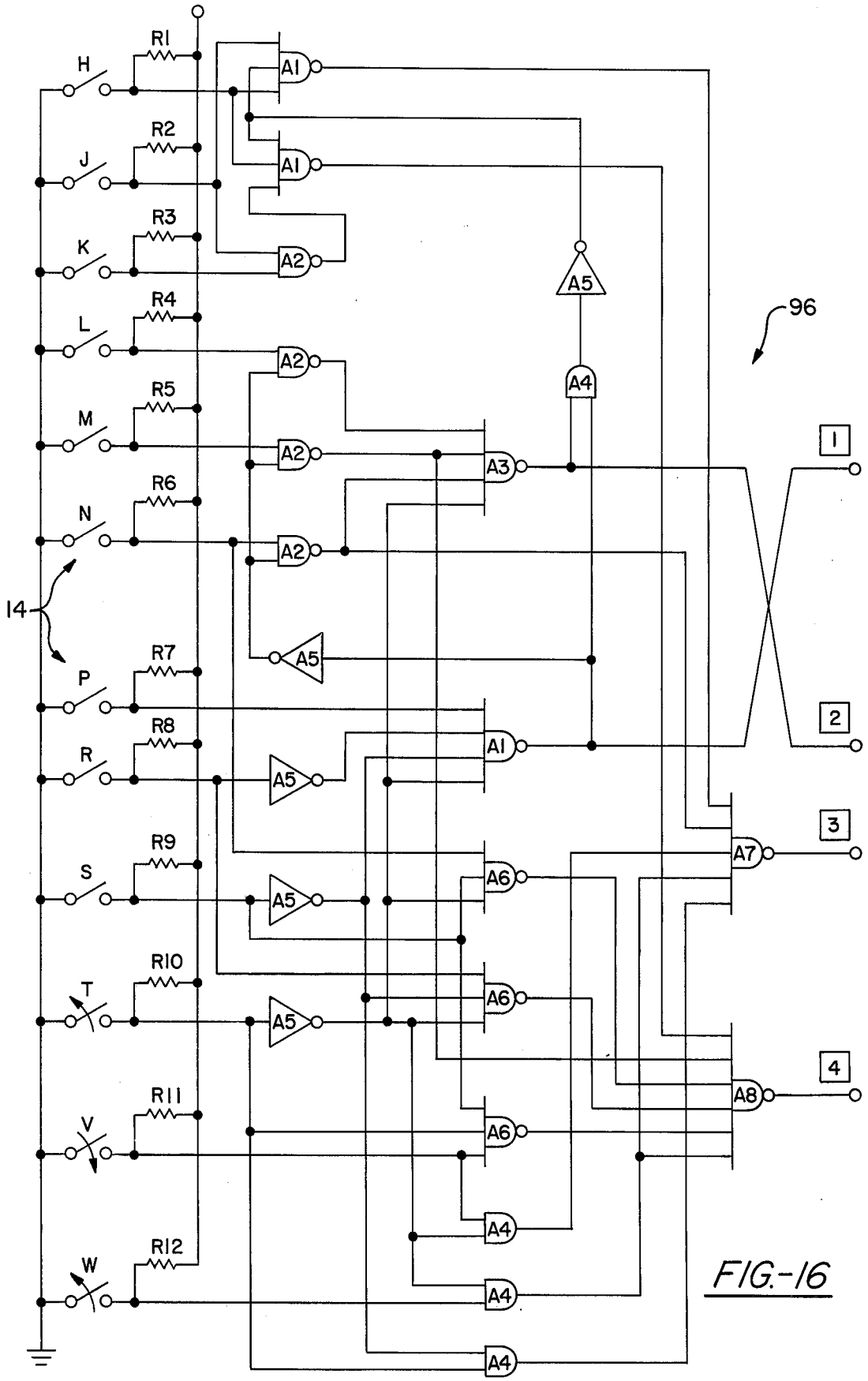
FIG. 16 is an electrical schematic of a binary key decoder for use in the present invention.

Looking at FIG. 16 in the electrical schematics the generation of the note D of FIG. 12 will be followed. As seen in the chart of FIG. 12, keys 14/T and W must be up and key 14/V must be down or depressed. As indicated, it is immaterial whether the remainder of the keys 14 are depressed or not depressed. As seen in the right hand column the binary number 1110 must be generated at the output terminals of binary key decoder 96. Therefore, switch T is open, V is closed and W is open. The input to device A5 connected to switch T is therefore high providing a low logic output at the output thereof due to the indicated inversion characteristic. Since this low output is connected to one input of the connected device A6, and since the other inputs are clearly at a high logical state, the output therefrom is at a high state. Thus, one input to NAND gate A8 is high and the remainder of inputs thereto must also be high to provide the necessary zero least significant bit in the binary number output. It may be seen that any combination of depressed or nondepressed keys H, J and K will produce a high state at the upper terminal of device A8. In like fashion, any combination of depressed or nondepressed keys L, M and N will produce a high state at the input of device A8 which is second from the top. Any combination of depressed or undepressed keys P, R and S, will provide a high state at the input to NAND gate A8 which is third from the top. The inputs to NAND gate A8 which are on the bottom and next to bottom in FIG. 16, are also in a high state for the predetermined key combination to provide the note D.

The least significant bit thus being in a logical low state the other three more significant bits must be shown to be in a high logical state. The given combination of open and closed keys 14 may be seen by following the circuitry of FIG. 16 to provide the desired binary number without regard for the open or closed condition of the keys 14 other than T, V and W. Keys 14 are single contact switches which are inexpensive and present no transients to the circuit due to the single contact closure, as opposed to minute contact closure time differences in multiple contact switches.

Figure 17:
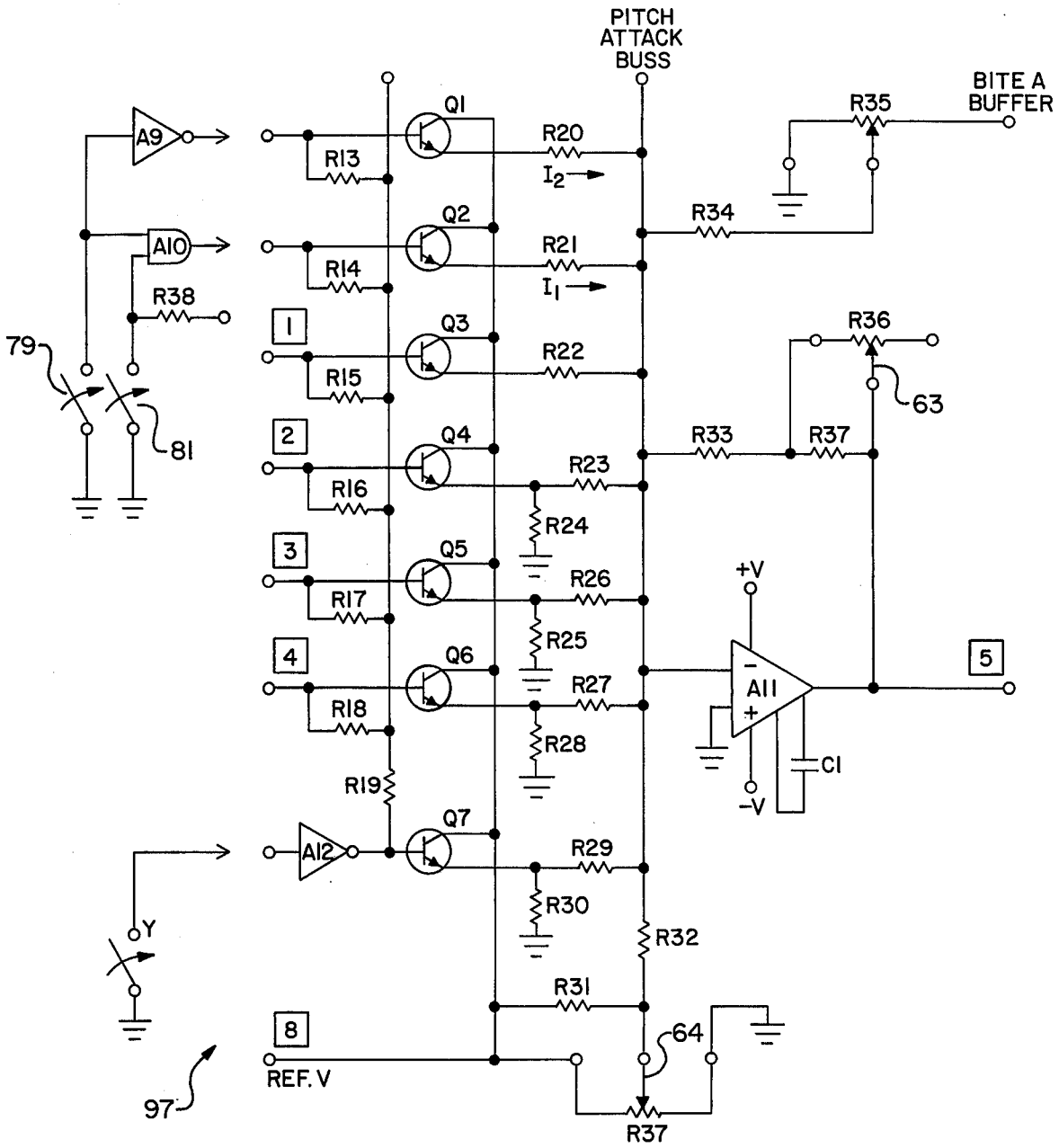
FIG. 17 is an electrical schematic of a six bit digital to analog converter for use in the present invention.

Binary key decoder 96 presents its output to the six bit digital to analog converter 97 shown in schematic form in FIG. 17. The most significant bit is presented to one end of R15 and the least significant bit is presented to one end of R18. Octave switches 79 and 81 are shown such that when both switches are open the input to inverter A9 is high producing a low output turning off Q1 and reducing I2 to substantially zero value. The inputs to AND gate A10 are both high producing a high at the base of transistor Q2 such that current $I_1$ flows through R21 to the pitch attack buss. Resistors R21 and R20 are configured so that I2=2I1. Therefore, for the normal condition just described, I1 only is produced by transistors Q1 and Q2. When the down octave switch 81 is depressed, a low state exists at the base of transistor Q2 and zero current flow to the pitch attack buss from transistors Q1 and Q2. When the up octave switch 79 is depressed, transistor Q1 has an energizing signal present at the base thereof and I2 flows from transistor Q1 to the pitch attack buss. I1 is extinguished by a low state at the base of transistor Q2. Therefore, transistors Q1 and Q2 either produce zero current, I1 or I2 to thereby provide current which is coupled to the exponential voltage controlled oscillator 106 shifting the output therefrom by one octave.

The binary number turning transistors Q3 through Q6 on or off, further provides current to the pitch attack buss for determining the magnitude of the control voltage from the digital to analog converter 97. When sharp key Y is depressed the control voltage at the output of amplifier A11 is raised by one semitone. Note that the tuning is performed at variable resistor R37 by means of control knob 64. Tuning may be obtained through plus or minus ten semitones of control voltage at the output of amplifier A11. Scale closure is obtained at variable resistor R36 by means of control knob 63 which provides a setting for precise octave separation, which is necessary due to the tolerances of the electronic components in the circuit. Variable resistor R36 changes the gain of amplifier All to perform the closure function. A reference input terminal is shown connected to the collectors of transistors Q1 through Q7.

Figure 18:
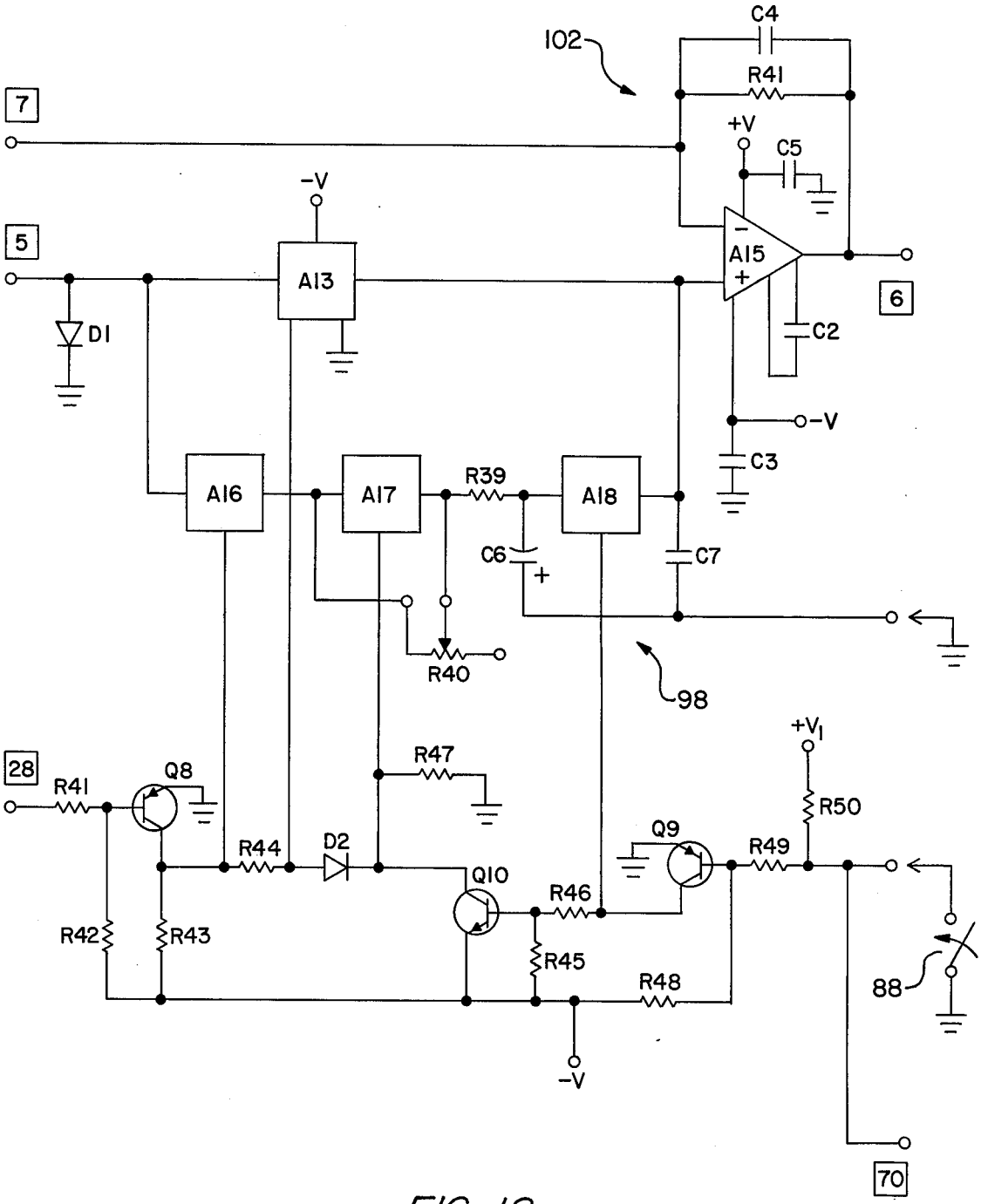
FIG. 18 is an electrical schematic of a portamento module for use in the present invention.

FIG. 18 shows the portamento module 98 receiving the tone signal from digital to analog converter 97 and passing the tone voltage on to adder 102 through the path occupied by device A13 or the path occupied by devices A16 through A18. With the portamento switch in the open position, the path through device A13 is selected. Device A13 does not pass the tone signal until the hold pulse from twenty millisecond monostable multivibrator 134 terminates.

Figure 29:
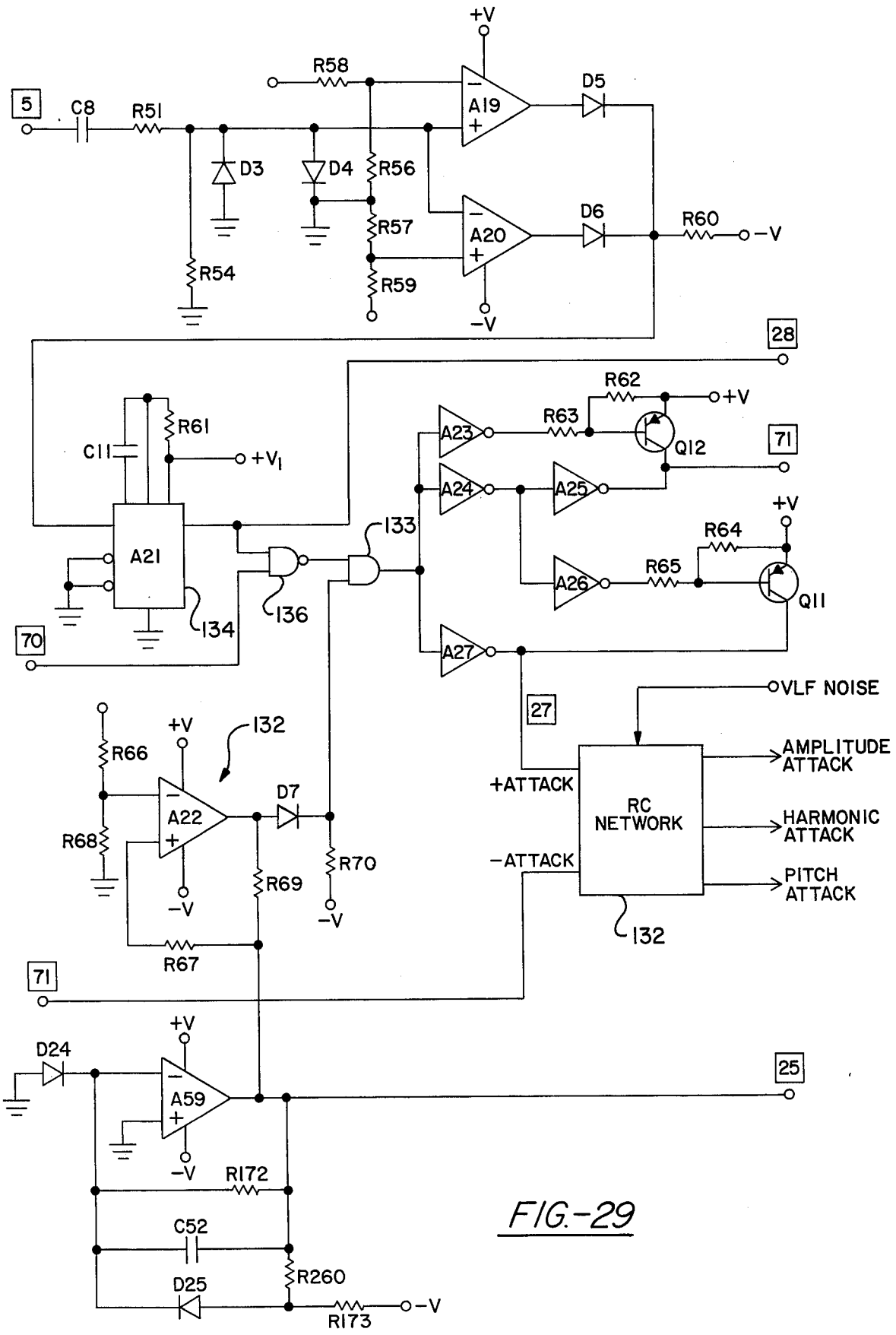
FIG. 29 is an electrical schematic of an attack detector and voice attack network for use in the present invention.

The schematic diagram for key attack detector 99 may be seen in FIG. 29, together with its connection to multivibrator 134. One input to attack reset gate 136 is high when portamento switch is open and the other input from multivibrator 134 is high for the 20 millisecond dwell time of the pulse from multivibrator 134. Therefore, one input to attack gate 133 is low for the twenty millisecond dwell time and an attack signal from pressure attack detector 132, being high is blocked at AND gate 133 for the twenty millisecond dwell time. Therefore attack drive is subdued for the twenty millisecond dwell time so that a new key position may be obtained by manipulation of the player's fingers without introducing transients into the instrument voice signal.

When portamento switch is closed as seen in FIG. 18, a low signal is delivered to attack reset gate 136 to provide a continuous high output therefrom since gate 136 is a nand gate. The twenty millisecond pulse from multivibrator 134 therefore does not affect the output of attack reset gate 136. The twenty millisecond pulse does however continue to be connected to portamento module 98 to remove transients due to fingering changes by the player by holding the last played note for the dwell time of the multivibrator pulse. With portamento selected, the tone control traverses the path seen in FIG. 18 occupied by devices A16 through A18. An RC network comprised of the combination of variable resistor R40 and resistor R39 together with capacitor C6, provides a continuously changing tone control voltage between an initial and final value at the input to adder 102. In this fashion, a "slur" is imparted to the tone control voltage at the output at adder 102 for subsequent coupling to the input of exponential voltage controlled oscillator 106, thereby providing continuously changing tone frequencies between an initial and final value as selected by a predetermined combination of depressed keys 14.

Figure 19:
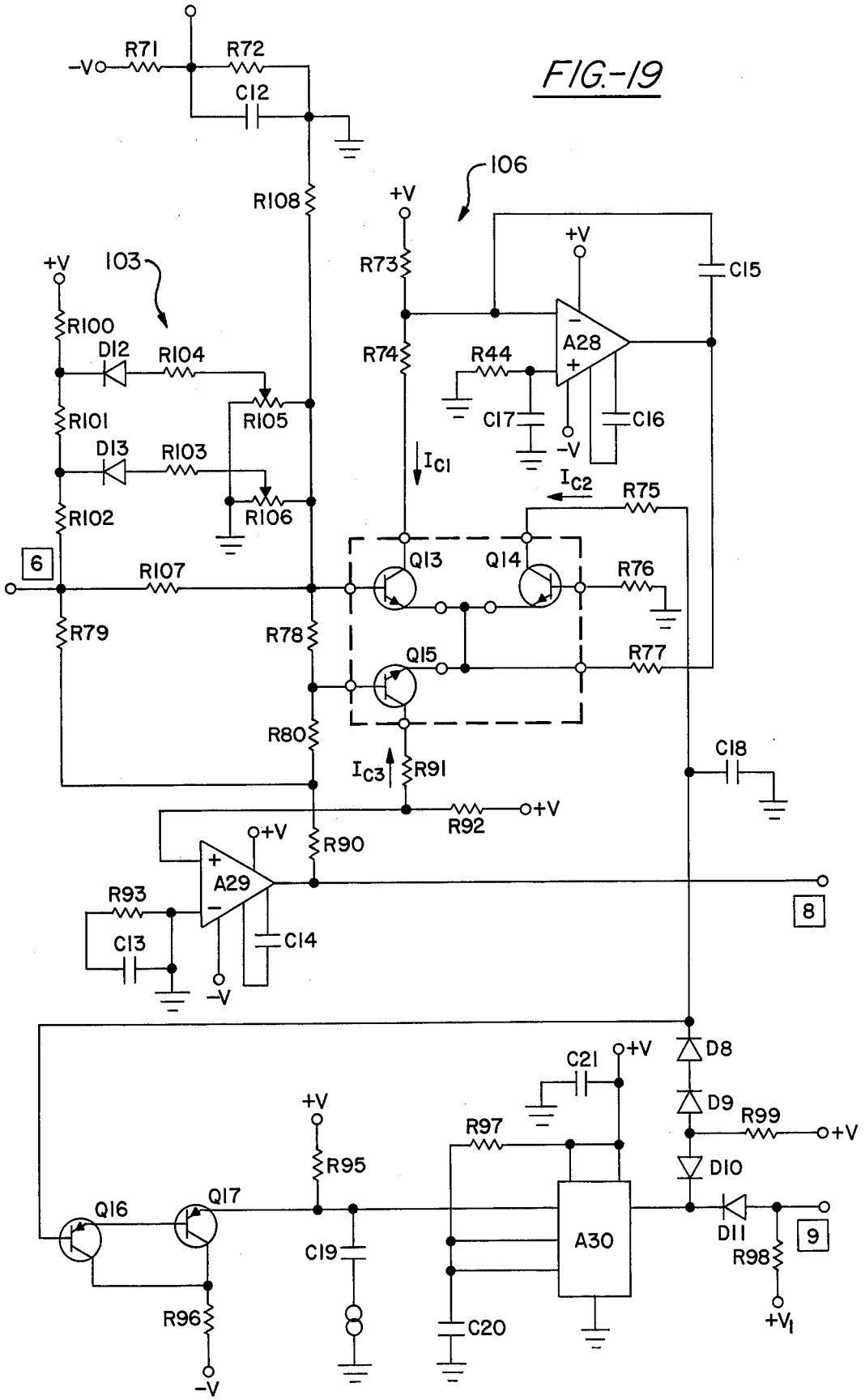
FIG. 19 is an electrical schematic of an exponential voltage controlled oscillator for use in the present invention.

Exponential voltage controlled oscillator 106 is shown in FIG. 19. Tone control signal is shown coming into one terminal of a four arm bridge formed by resistor R107, R78, R80 and R79. The ratio of R107 to R79 is the same as the ratio of R108 to R90. Therefore any change in tone control signal at the junction between resistors R107 and R79 will not produce any change the junction between resistors R107 and R78. A reference pair of transistors is seen in transistors Q13 and Q15. An exponentiating pair of transistors is seen in transistors Q13 and Q14. Transistor Q13 is common to both pairs. Transistors Q13, Q14 and Q15 have a common heat sink, since they are all formed on the same chip. The base of transistor Q13 is connected to the node between resistors R107 and R78 so that tone control voltage changes do not change the potential difference between the bases of transistors Q15 and Q13. Since a constant current is provided by operational amplifier A28 to the collector of Q13 and a constant current is provided by operational amplifer A29 to the collector of transistor Q15, the only variable which may cause change in potential between the bases of the two transistors in the reference pair is the temperature of the common heat sink on the chip containing the reference pair. When the constant collector currents through transistors Q15 and Q13 are in the ratio of ten to one the following well known equation obtains $$\frac{Ic3}{Ic1} = 10 = \frac{q}{ekT}(V_{be3} - V_{be1}) = e\frac{q}{kT}(\Delta V_R).$$

Where IC3 is the collector current for Q15, IC1 is collector current for Q13, and $V_{be3}-v_{bel}$ is a difference in potential between the bases of transistors Q15 and Q13. This relationship simplifies to the following; $\Delta V_R = kt/q$ ln 10, where k is Boltzman's constant, $q$ is electron charge and T is absolute temperature in degrees Kelvin. It is thus seen that change in potential between the bases of reference transistors Q13 and Q15 is proportional to the absolute temperature of the transistors.

Since the tone signal does not change the potential between the nodes on the bridge between resistors R107 and R78 and between R79 and R80, any change occurring at the output of device A29 must be due to a temperature imposed change in the potential between the bases of transistors Q15 and Q13. The output voltage from device A29 is a reference voltage which is connected to the collectors of Q1 through Q7 in the digital to analog converter 97 for controlling the current in the pitch attack buss and thereby adjusting the analog output or tone signal in accordance with the temperature of the transistors Q13 through Q15. Since the exponentiating pair transistors Q13 and Q14 experience the same temperature as the reference pair Q13 and Q15, the corrected tone voltage causes an adjustment in IC2 to overcome the temperature effects in the transistors. This may be demonstrated by reference to the following relationships, $$\frac{Ic2}{Ic1} = e\frac{q}{kT}(V_{be2} - V_{be1}),\ V_{be2} = 0 \text{ (grounded)},$$

$$I_{c2} = I_{c1}\, e\frac{q}{kT}(-V_{be1}),\ -V_{be1} = K\Delta V_R,$$

$$I_{c2} = I_{c1}e^{K(ln\ 10)} = I_{c1}e^{Kln10}.$$

Where IC2 is the collector current of transistor Q14 which is the control current for the current controlled oscillator including device A30. It may be seen that the control current, IC2, is an exponential function of the current IC1 where the constant K is determined by the circuit parameters. In this fashion, the tone frequency is provided at the output of device A30. The resistor diode network including resistors R100 through R106 and diodes D12 and D13, performs a linearization of the exponential relationship shown in FIG. 9. The nonlinear relationship shown by the dashed line results from the tolerances on the circuit components and departure from ideal behavior of transistors Q13 and Q14. The linearizer circuit 103 produces the solid line showing the logarithm of the output frequency as a linear function of the input or tone control voltage.

Figure 20:
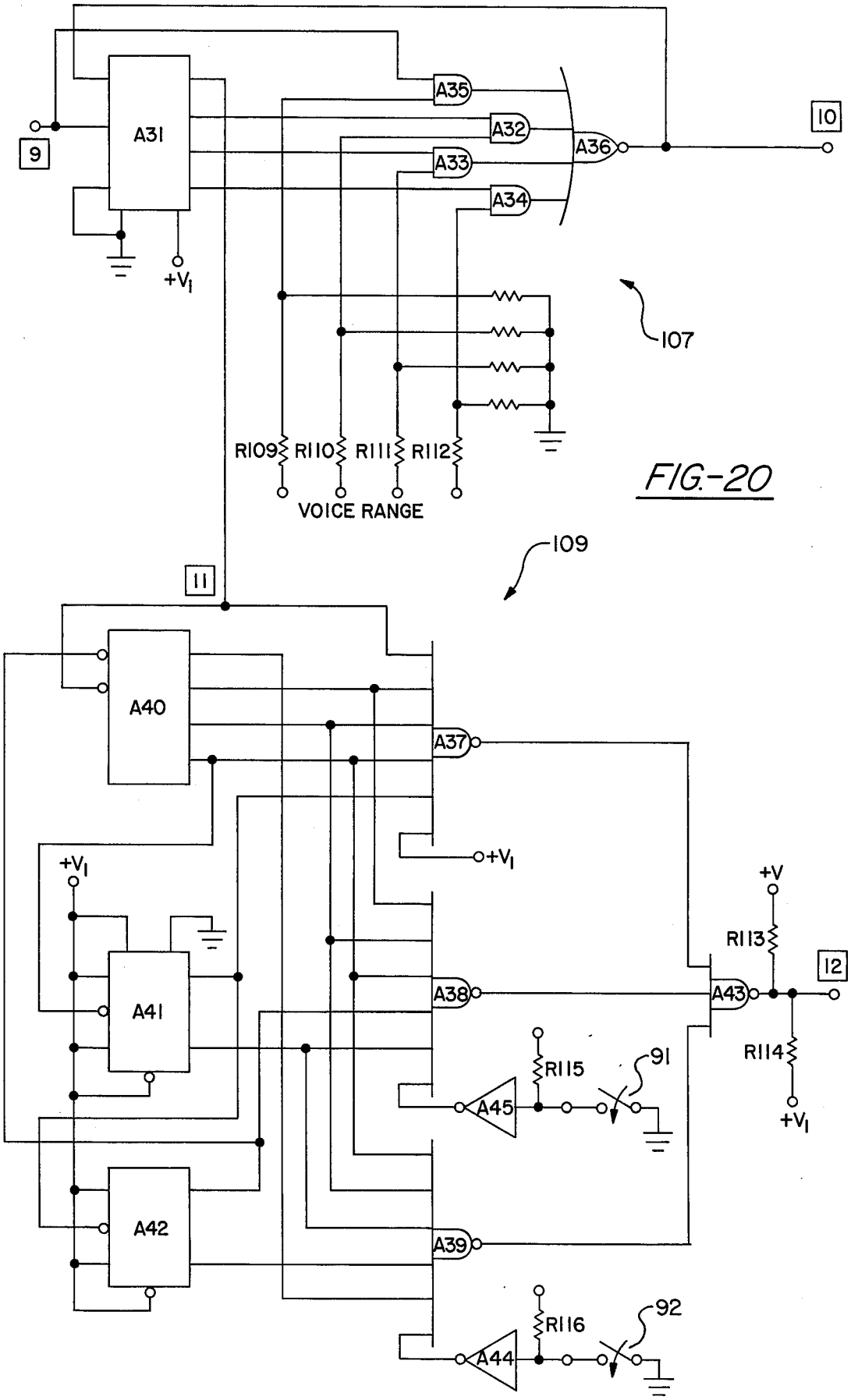
FIG. 20 is an electrical schematic of a voice range divider and a double triple circuit for use in the present invention.

The voice range divider 107 is seen in FIG. 20 of the electrical schematics where a pulse is provided to the input of device A31 which is a binary divider. Divider A31 provides a division of the input pulse by 2, 4 or 8 through gates A32, A33 and A34 respectively. Gate A35 presents the undivided input pulse. One of the gates A32 through A35 is selected by applying a logical high state to one of the resistors R109 through R112. A clock output is provided from gate A36 in accordance with the selected division of the input pulse. Binary divider A31 also provides an output signal related to the input pulse and divided by two in frequency having a 50% duty cycle and therefore being a square wave. The square wave from binary divider A31 is provided to the double/triple circuit 109 seen in FIG. 20.

Figure 15:
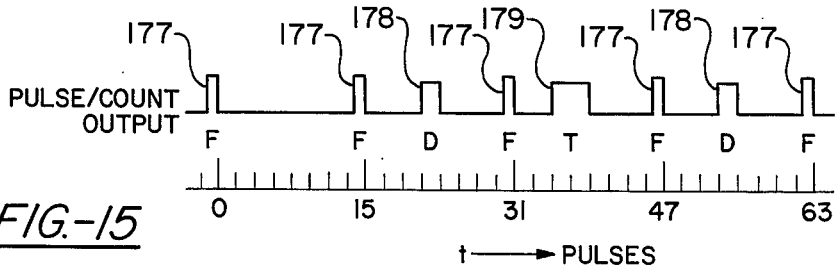
FIG. 15 is a timing diagram related to the doubling and the tripling gating in the disclosed circuit.

Referring to FIG. 15 the time incidence of the fundamental pulse 177 is shown relative to the time incidence of the doubling pulse 178 and the tripling pulse 179 obtained from the circuit of FIG. 20. The double/triple gating circuit 109 of FIG. 20 prevents time coincidence between the three pulses. The doubling and tripling selection takes place at switches 91 and 92 respectively as discussed in conjunction with FIG. 6 above.

Figure 21:
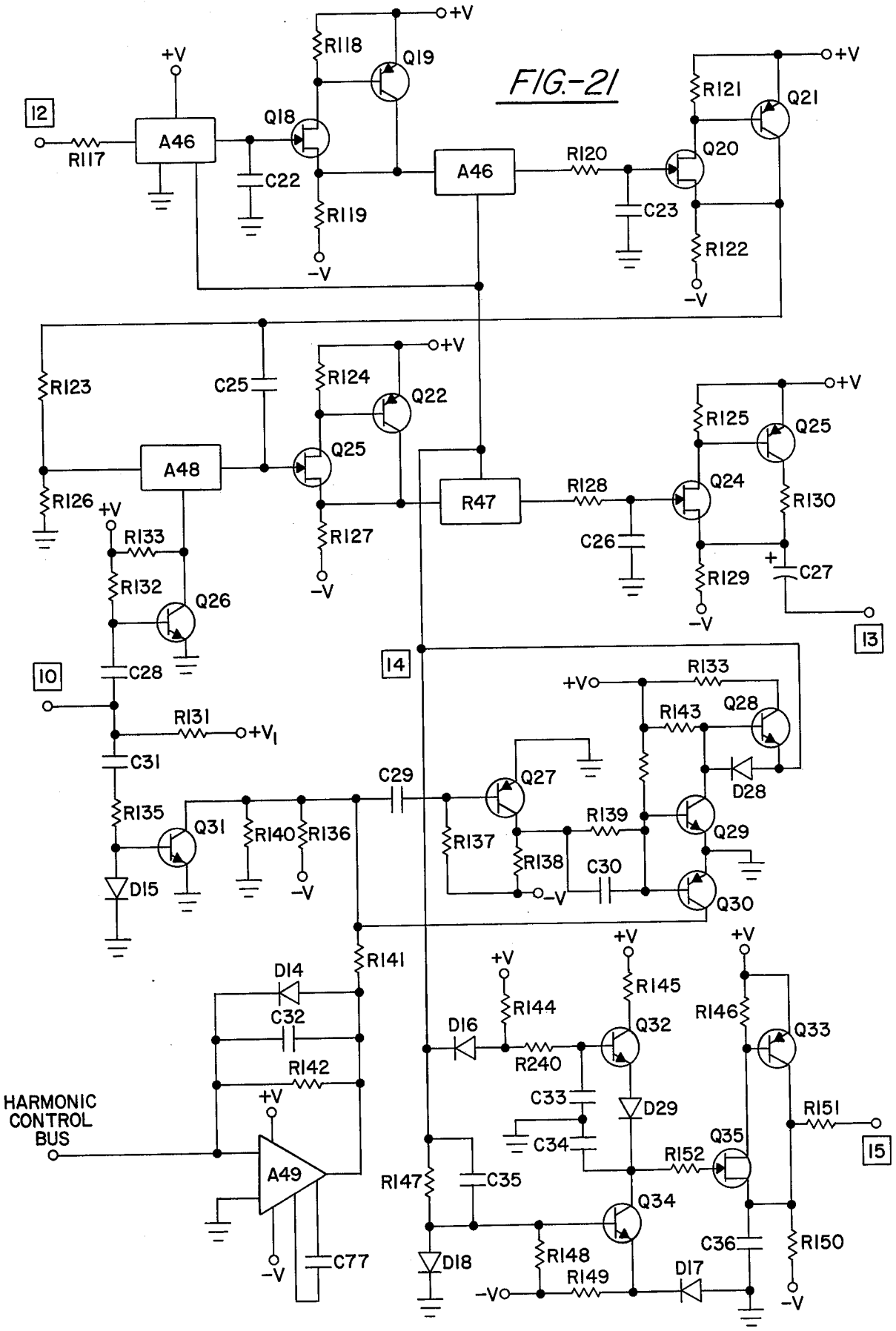
FIG. 21 is an electrical schematic of a harmonic control filter for use in the present invention.

Harmonic control filter 112 is seen in the schematic of FIG. 21. The output is adjusted so that the same percentage harmonic exists for any fundamental output pitch.

Figure 22:
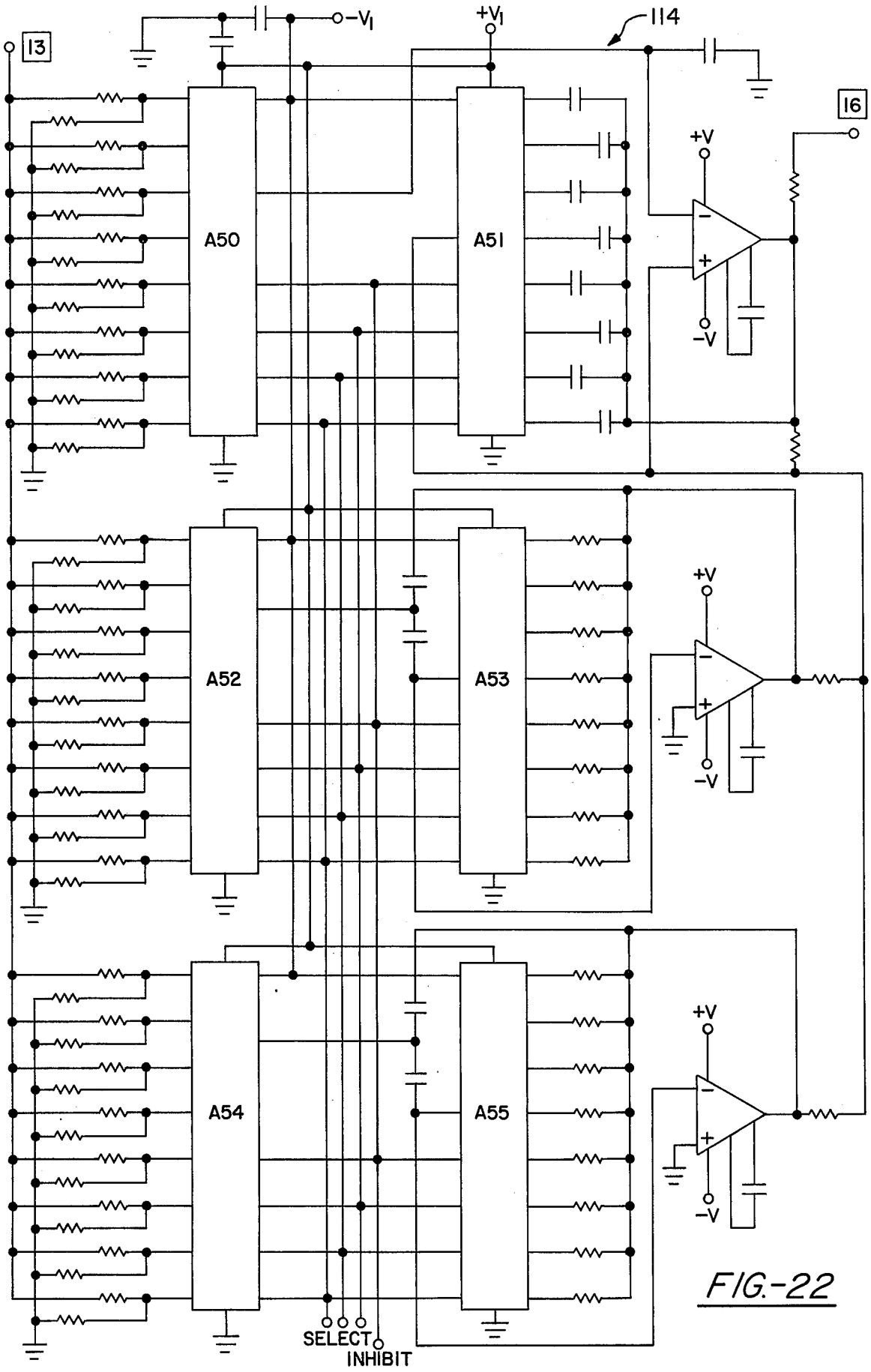
FIG. 22 is an electrical schematic of a formant filter for use in the present invention.

Formant filters to obtain the predetermined voice characteristics such as those seen in FIGS. 10 and 11, are filters containing active elements and thoroughly discussed in the prior art. Analog switches indicated as devices A50 through A55 are utilized as gates to select the necessary filter components in the resistor and capacitor networks shown in conjunction with switches A50 through A55 to obtain the predetermined voice characteristic. A format filter represented by block 114 in FIG. 7, is seen on the schematic diagram of FIG. 22.

The output from harmonic control filter 112 of FIG. 21 is connected to the input of correction voltage circuit 118 also seen in FIG. 21, so that a correction voltage may be obtained therefrom to replace the fundamental amplitude which is lost when harmonics are being deleted.

Figure 23:
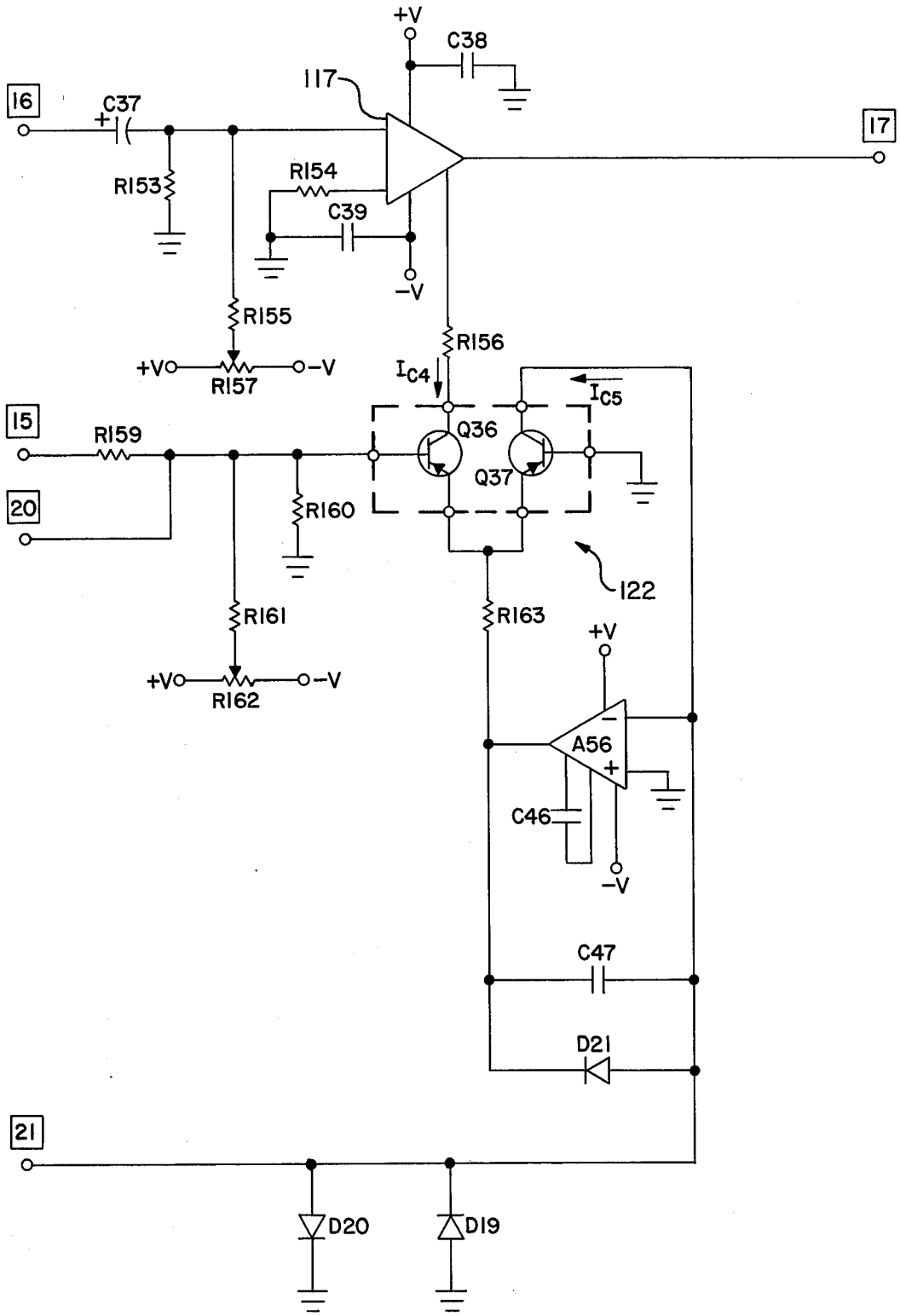
FIG. 23 is an electrical schematic of a renormalizer for use in the present invention.

The output from formant filter 114 is directed to variable gain amplifier 117 seen in FIG. 23 having a gain which is set by current IC4, which is the collector current of transistor Q36. Current IC5 is the collector current of transistor Q37 and is from the linear gain control buss. The log gain buss is connected to the base of transistor Q36 and is represented by $V_G$, so that the following relationship applies;

$$\frac{Ic4}{Ic5} = e\frac{q}{kT}(V_{be4} - V_{be5}) = e\frac{q}{kT}V_G,\ I_{c4} = I_{c5}e\frac{q}{kT}(V_G).$$

IC4 is the collector current of Q36, IC5 is the collector current of Q37, $V_{be5}$ is zero, and $V_G$ is equivalent to $V_{be4}$, and is the log gain control. In this fashion, exponentiator 112 provides the input to variable gain amplifier 117 as described in conjunction with FIG. 7 above. The output from variable gain amplifier 117 is coupled to the input of variable gain amplifier 126, seen in the block diagram which has the pressure signal as an input thereto for producing an output to gross volume control 127. Pre-amplifier 128 provides the instrument voice signal at the output thereof at one of the jacks 29 seen in FIG. 3.

Figure 24:
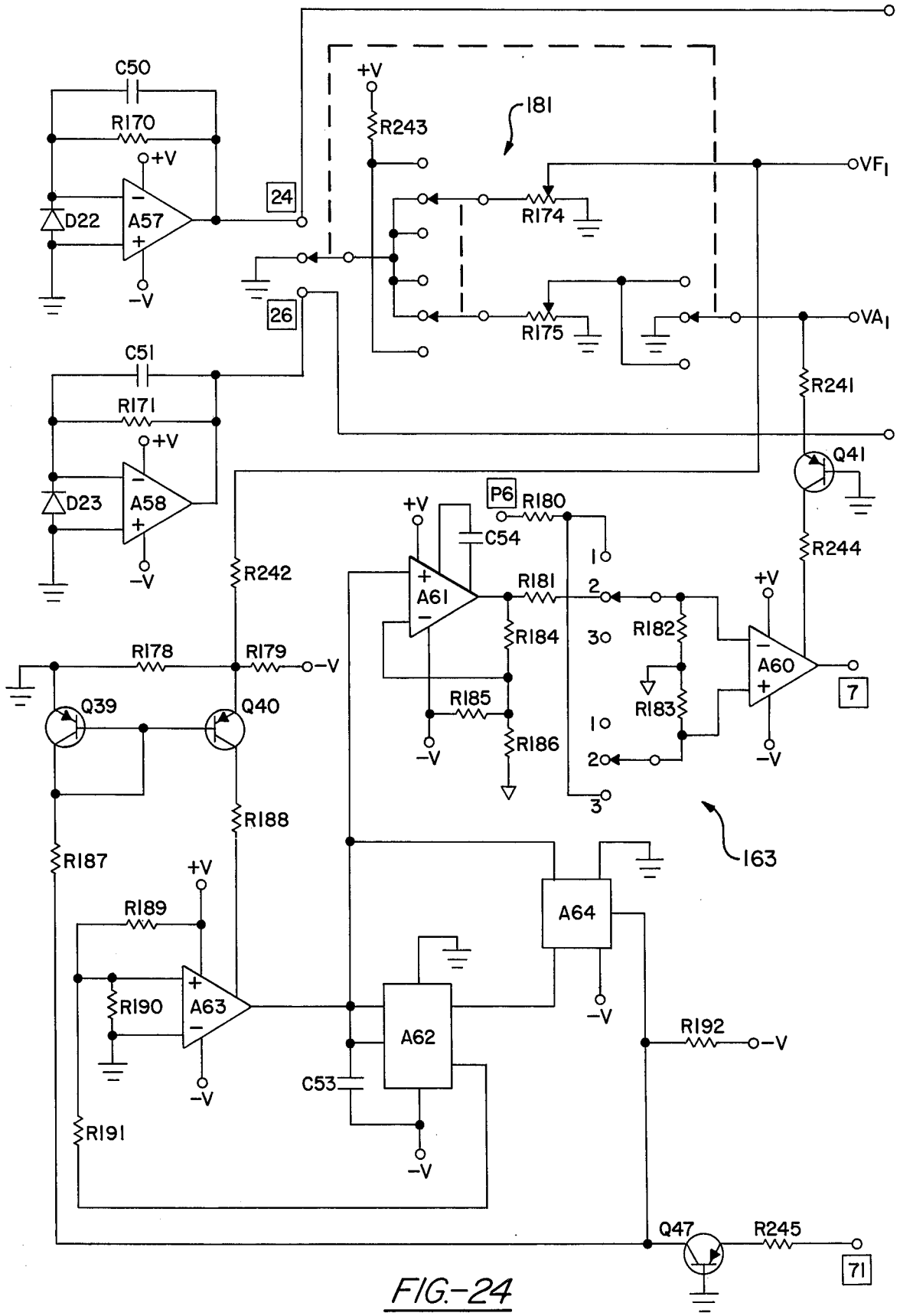
FIG. 24 is an electrical schematic showing pressure and displacement signal generation and frequency modulaton control for use in the present invention.

In FIG. 24 of the schematic diagrams, photodiode D22 is associated with bite transducer A. Buffer amplifier A57 receives the output from photodiode D22 and provides a bite A signal output ranging from zero to twelve volts. Bite transducer B is identical to that of transducer A utilizing a photodiode D23 and a buffer amplifier A58 for producing the bite B signal output. A pressure signal is produced by connecting the output from pressure transducer photodiode D24 to the input of buffer amplifier A59 for producing the pressure signal output also from 0 to plus 12 volts. A control switch 181 is provided for selecting the bite A or bite B signals rate control as indicated at 157 on FIG. 8 is obtained by adjustment of variable resistor R174 and excursion is obtained by adjustment of variable resistor R175. The rate and excursion outputs are directed to the input terminals of a vibrato oscillator or frequency modulated oscillator 163 seen in FIG. 24 for producing a frequency modulating control output at the output of device A60. Frequency modulation or vibrato control of exponential VCO 106 is obtained by coupling the frequency modulating control output thereto through adder 102 as seen in FIG. 7.

Figure 25:
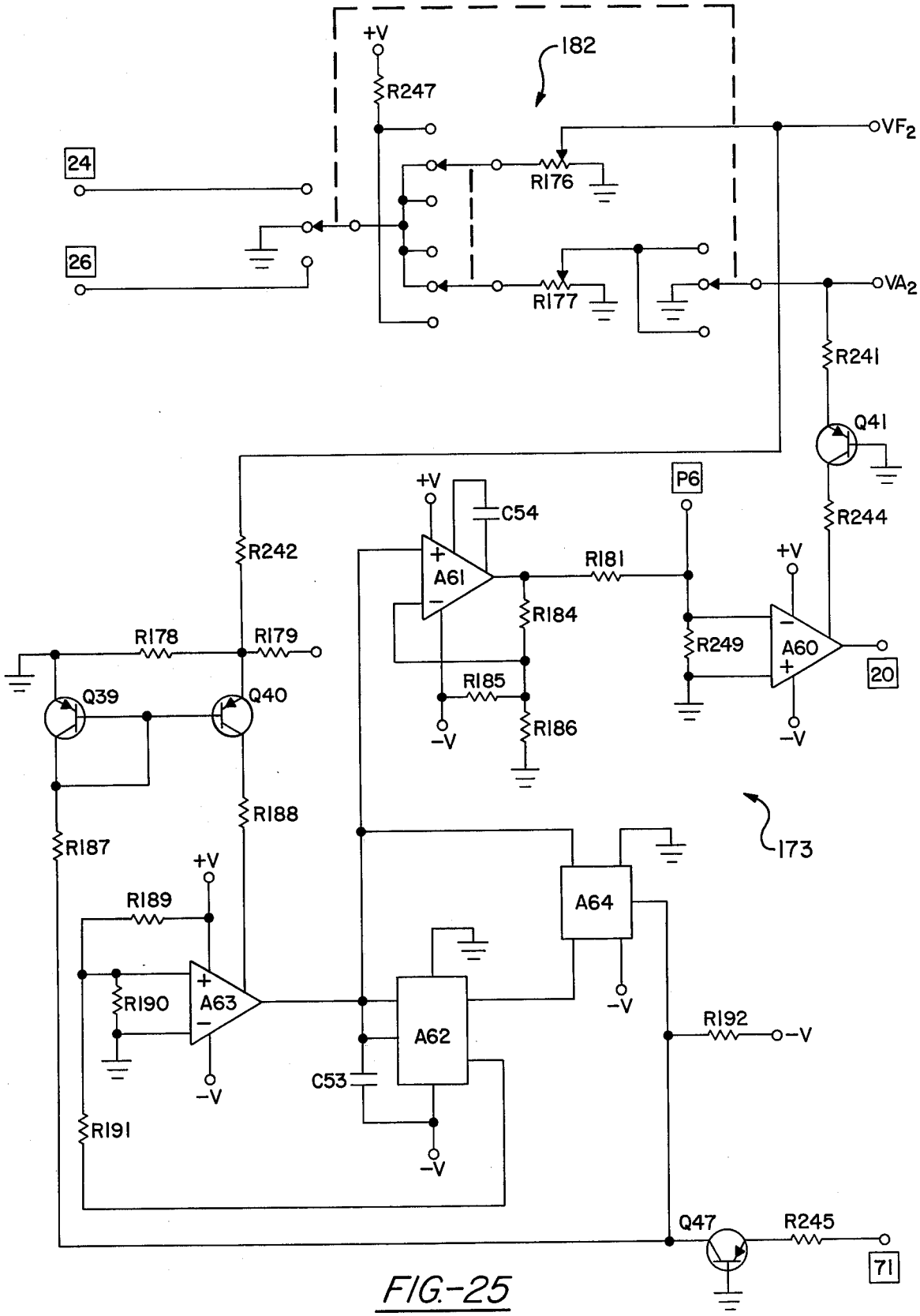
FIG. 25 is an electrical schematic showing amplitude modulation control for use in the present invention.

A second switch 182 similar to switch 181 is seen in FIG. 25 having rate and excursion adjustments by means of variable resistors R176 and R177 respectively for providing an input to the terminals of a tremolo or amplitude modulated oscillator 173. The output of the tremolo oscillator 173 produces a tremolo or amplitude modulation control output which is coupled to exponentiator 122 through adder 119 as seen in FIG. 7. Special effects are selected for injection into the voice output signal by manipulation of the controls 67 through 72 on the rear control panel 18.

Figure 13:
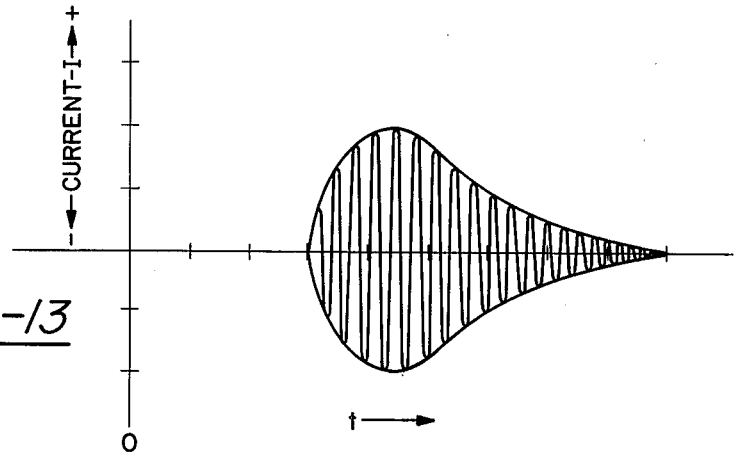
FIG. 13 is a curve showing inharmonic characteristics for injection into the attack phase.
Figure 27:
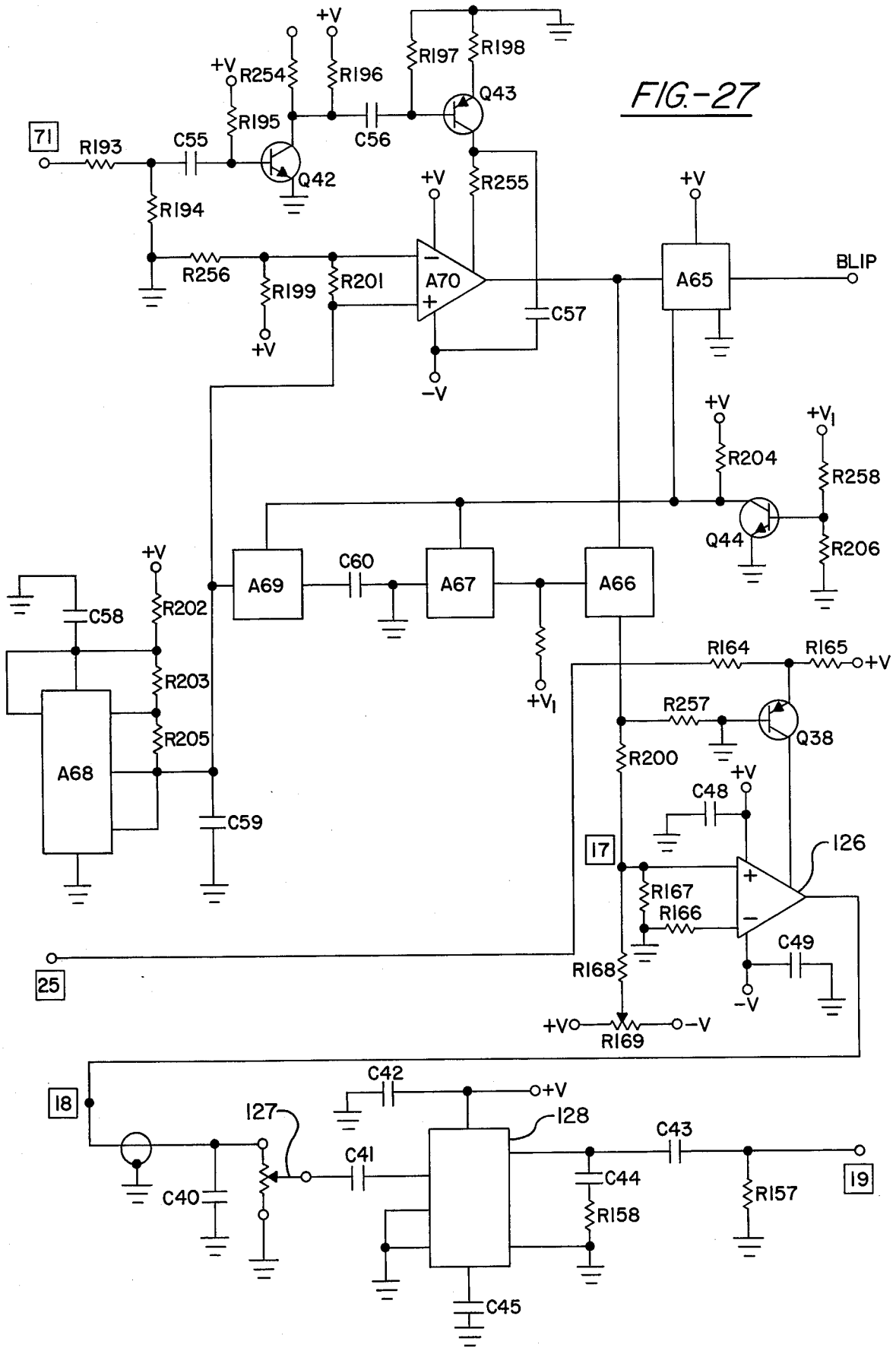
FIG. 27 is an electrical schematic of an audio gain control and "blip" and inharmonic signal generator for use in the present invention.

A "blip" and inharmonic generator is seen in the schematic of FIg. 27 for producing a "blip" signal to simulate the voice of brass instruments. An inharmonic tone having the envelope seen in FIG. 13 is provided having a frequency of 900 hertz for saxiphone inharmonic and 60 hertz for brasses. The envelope of FIG. 13 is a damped sine pulse which occurs during the attack phase of a note. The inharmonics are independent of the note being played and provide a voice characteristic which is peculiar to the predetermined voice selected.

Figure 26:
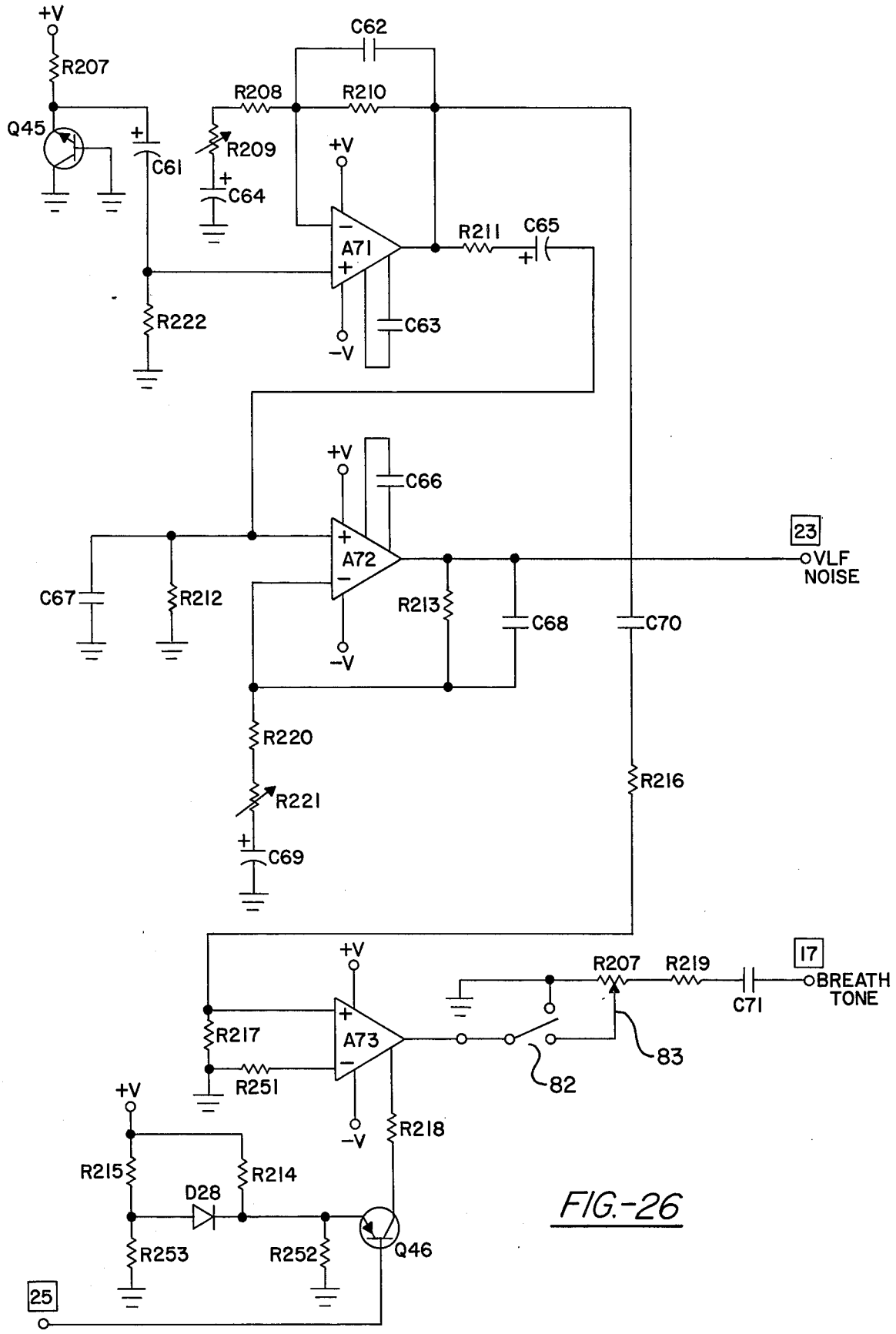
FIG. 26 is an electrical schematic of a breath tone and very low frequency noise generator for use in the present invention.

As shown in the schematic of FIG. 26 and block diagram FIG. 8, a noise source including device A71 presents an output which is passed through a low pass filter and provided at the output of device A72 as a very low frequency noise for attachment to the voice attack network 138. Breath tone is selected by means of on/off switch 82 and breath tone intensity obtained from variable potentiometer R207 actuated by means of breath tone intensity control 83 on rear panel 18.

Figure 28:
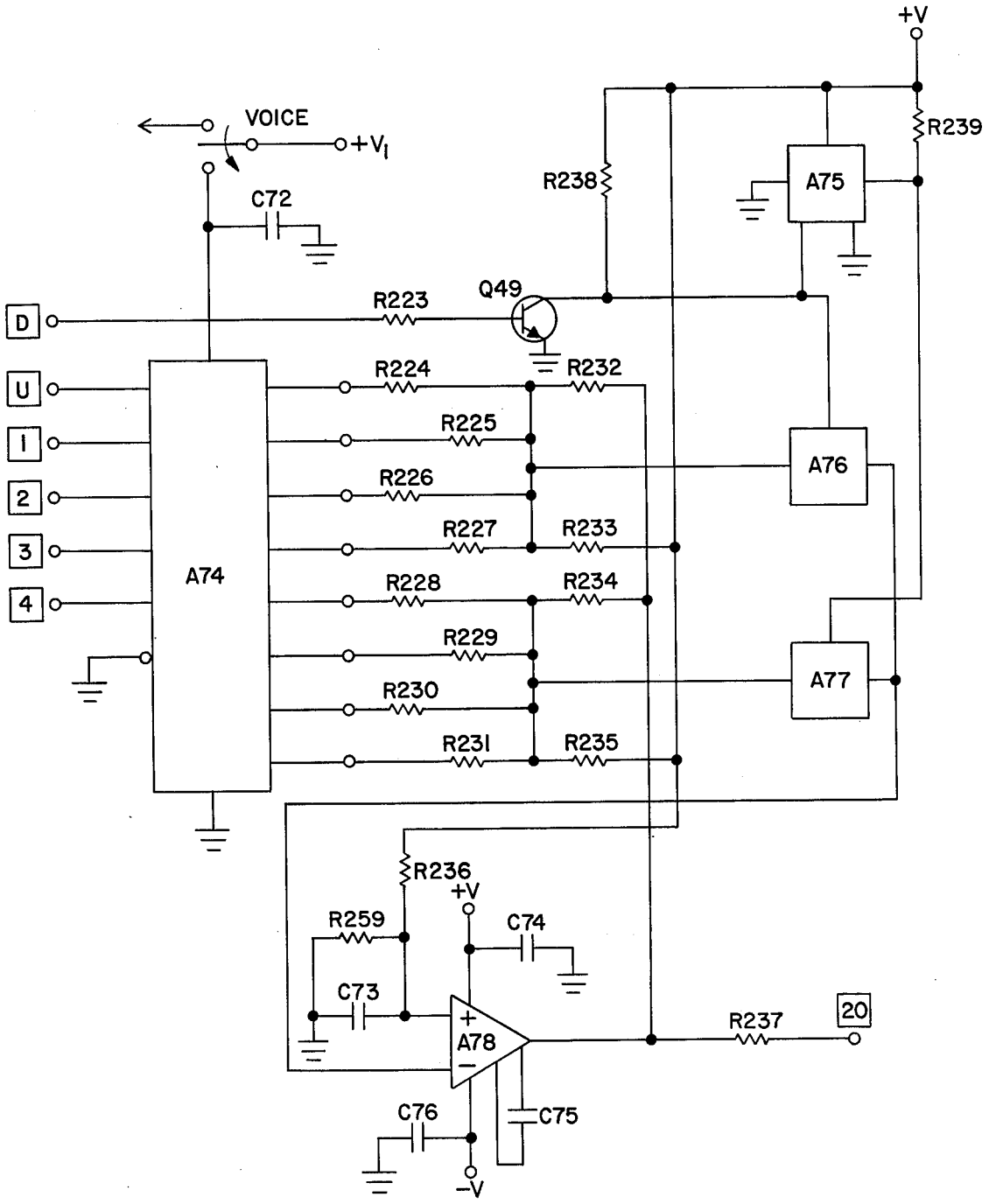
FIG. 28 is an electrical schematic of a readonly memory and digital to analog converter for use in the present invention.

A read-only memory and digital to analog converter electrical schematic is seen in FIG. 28, which is used for receiving the six bit binary output labeled digital pitch control. Read-only memory seen as device A74 may contain a preset program for producing an output voltage for adjusting the overall voltage at the output terminal 129 to correct for amplitude losses in the format filter 114. A voice attack network 138 receives the negative and positive attack drive signals as well as the very low frequency noise signal and provides amplitude, harmonic and pitch attack signal outputs.

What is claimed is:

1. An electronic musical instrument for operation by means of combination mouth and finger manipulation by a player, comprising a framework, a key panel attached to said framework, a plurality of key switches mounted for access by the player's fingers at said key panel, each of said plurality of key switches providing a key signal corresponding to the player's finger pressure, a key decoder for receiving said key signal from each of said plurality of key switches, said key decoder providing a digital code output for each of a plurality of predetermined key signal combinations, a digital to analog converter for receiving said digital code output and providing a tone signal corresponding thereto, an exponential voltage controlled oscillator coupled to said digital to analog converter for receiving said tone signal and providing a tone frequency which is an exponential function of said tone signal, said tone frequency having a fundamental frequency, a harmonic control filter coupled to said exponential voltage controlled oscillator and providing a harmonic controlled frequency containing substantially the same proportion of harmonics for any tone frequency, a formant filter for receiving said harmonic controlled frequency and providing a voice frequency having a harmonic content dependent upon said fundamental frequency, whereby the waveshape of said voice frequency is similar to the frequency of a predetermined voice, a mouthpiece attached to said framework adapted to be received in the player's mouth, a channel extending through said mouthpiece for communication with the player's mouth at one end, a pressure transducer mounted in said mouthpiece in communication with said channel and providing a pressure signal corresponding to pressure in said channel, whereby said pressure signal corresponds to breath pressure at the player's mouth, a pressure attack detection circuit for receiving said pressure signal and providing a pressure attack signal, and a variable gain amplifier coupled to said formant filter for receiving said voice frequency and coupled to said pressure transducer and said pressure attack detection circuit for control by said pressure signal and said pressure attack signal and providing an instrument voice signal, whereby introduction of breath pressure into said mouthpiece simultaneously with finger pressure by the player on a predetermined combination of said plurality of key switches produces predetermined pitch and timbre characteristics in said instrument voice signal which are peculiar to said predetermined voice.

2. An electronic musical instrument as in claim 1 together with a low frequency noise source for providing an audio frequency noise signal, said low frequency signal being coupled to said variable gain amplifier for producing breath tone effect in said instrument voice signal.

3. An electronic musical instrument as in claim 1 together with means for generating an inharmonic frequency which is peculiar to said predetermined voice, said inharmonic frequency being coupled to said variable gain amplifier.

4. An electronic musical instrument as in claim 1 together with a key octave switch for providing an octave signal when actuated, said octave signal being connected to said digital to analog convertor for changing said tone signal for shifting said tone frequency through an octave.

5. An electronic musical instrument as in claim 1 wherein said digital to analog converter has a reference terminal and wherein said exponential voltage controlled oscillator comprises a reference pair of transistors, an exponentiating pair of transistors producing an output current related exponentially to said tone signal, said exponentiating pair and said reference pair including a common transistor, a common heat sink for said reference and exponentiating pairs of transistors, said tone signal being connected to the base of said common transistor so that changes therein have no effect on the potential difference between the bases of said reference pair, first and second constant current generators for providing constant collector current in each of said reference pair whereby the potential difference between the bases of said reference pair is dependent on the temperature of said common heat sink only, so that when the potential difference between the bases of said reference pair is connected to said reference terminal, said tone signal is adjusted in magnitude to compensate for error in said output current resulting from temperature change at said common heat sink, and a current controlled oscillator connected to receive said output current and providing said tone frequency.

6. An electronic musical instrument as in claim 1 wherein said exponential voltage controlled oscillator comprises first, second and third transistors having base, emitter and collector terminals, a common heat sink for said transistors, first, second, third and fourth resistors connected to form a resistive bridge circuit, said first and second resistors being connected at an input node, said second and third resistors being connected at a first common node, said third and fourth resistors being connected at a second common node, and said first and fourth resistors being connected to said output node, said tone signal being connected to said input node, said first transistor base being connected to said first node and said third transistor base being connected to said second node, so that changes in magnitude of said tone signal are ineffective in changing potential between said first and third transistor bases, first and second constant current generators for supplying constant collector current for said first and third transistors, whereby change in potential between said first and third transistor bases is a function of temperature of said common heat sink and results in a change in said reference signal, said first and second transistors being connected so that collector current in said second transistor is related exponentially to said tone signal, and a linear current controlled oscillator for receiving said second transistor collector current, said reference signal being connected to said digital to analog converter for changing the magnitude of said tone signal sufficiently to cancel change in said second transistor collector current due to changes in said common heat sink temperature.

7. An electronic musical instrument as in claim 1 together with a key attack detector coupled to receive said tone signal and providing a key pulse output for a change in said tone signal, an attack gate for receiving said key pulse output and said pressure attack signal and providing an attack drive signal, and a voice attack network for receiving said attack drive signal and providing predetermined voice attack output having a dwell time corresponding to the attack time peculiar to said predetermined voice, said predetermined voice attack output being coupled to said variable gain amplifier, whereby said instrument voice signal includes attack characteristics peculiar to said predetermined voice.

8. An electronic musical instrument as in claim 7 together with means for adjusting said formant filter and means for adjusting said voice attack network, thereby providing said voice attack output and voice frequency corresponding to attack and steady state characteristics in said instrument voice signal respectively, said voice attack signal including a harmonic attack signal and a pitch attack signal, said harmonic attack signal being coupled to said variable gain amplifier through said harmonic control filter, and said pitch attack signal being coupled to said variable gain amplifier through said exponential voltage controlled oscillator.

9. An electronic musical instrument as in claim 7 wherein said voice attack network includes program means for converting said attack drive signal to said predetermined voice attack output.

10. An electronic musical instrument as in claim 7 together with a low frequency noise source for providing a low frequency signal, said low frequency signal being coupled to said voice attack network for producing sub-audible noise in said instrument voice signal.

11. An electronic musical instrument as in claim 7 together with a portamento module for receiving said tone signal and for transmitting said tone signal to said exponential voltage controlled oscillator, a portamento key mounted on said framework accessible to the player's fingers for providing a portamento select signal when actuated, said portaments select signal being connected to disable said attack gate, whereby changes in said tone signal produce continuous tone frequency changes.

12. An electronic musical instrument as in claim 11 together with means for adjusting the rate of change of said tone signal.

13. An electronic musical instrument as in claim 1 together with a bite transducer mounted in said mouthpiece for engagement with the player's mouth and providing a bite signal in response to operation thereof by the player's mouth, an oscillator for receiving said bite signal and providing an oscillatory output related thereto, said oscillatory output being coupled to said variable gain amplifier for providing an oscillatory effect in said instrument voice signal.

14. An electronic musical instrument as in claim 13 together with means for adjusting rate of said oscillatory output and means for adjusting excursion thereof.

15. An electronic musical instrument as in claim 13 together with an additional bite transducer mounted in said mouthpiece for engagement with the player's mouth and providing an additional bite signal in response to operation thereof by the player's mouth, an additional oscillator for receiving said additional bite signal and providing an amplitude modulating output related thereto, said oscillatory output being a frequency modulating output for modulating said tone frequency, said amplitude modulating output being coupled to said variable gain amplifier whereby frequency and amplitude modulation effects are provided in said instrument voice signal.

16. An electronic musical instrument as in claim 15 together with means for selectively locking said frequency and amplitude modulating outputs in phase and out of phase for providing a special effect in said predetermined voice.

17. An electronic musical instrument as in claim 1 together with a divider coupled to said tone frequency for providing a divided tone frequency, a doubling circuit for receiving said divided tone frequency and providing a doubling output of one half the divided tone frequency which is out of coincidence with said divided tone frequency.

18. An electronic musical instrument as in claim 17 together with a tripling circuit for receiving said divided tone frequency and providing a tripling output having a frequency which is one fourth of each divided tone frequency and out of coincidence with said divided tone frequency and said doubling output.

19. A breath pressure actuated electronic musical instrument for operation by finger manipulation of a player comprising an instrument body, a mouthpiece attached to said instrument body adapted to be received in the player's mouth, a key panel attached to said instrument body, a plurality of keys mounted on said key panel in accessible positions for actuation by the player's fingers, each of said keys producing a key pulse when actuated, a key decoder for receiving said key pulses in predetermined combinations and producing a digital output corresponding thereto, a digital to analog converter for converting said digital output to a tone signal corresponding thereto, an exponential voltage controlled oscillator for receiving said tone signal and producing a tone frequency output which is exponentially related to said tone signal, said exponential voltage controlled oscillator including means for producing an internal control signal for controlling said tone frequency, said internal control signal being variable as a function of temperature for a predetermined magnitude of said tone signal, a formant filter having an input coupled to the output of said exponential voltage controlled oscillator and providing a voice frequency output having characteristics of a predetermined voice, a pressure transducer mounted in said mouthpiece for providing a pressure signal output, a channel in said mouthpiece for communicating said pressure transducer with the player's breath, means for sensing the temperature of said means for producing an internal control signal and providing a reference signal corresponding thereto, said reference signal being connected to said digital to analog converter for adjusting said tone signal to maintain said internal control signal independent of temperature for a predetermined combination of said key pulses, and a variable gain amplifier coupled to the outputs of said formant filter and said pressure transducer, whereby simultaneous fingering of ones of said plurality of keys and application of breath pressure by the player produces an instrument voice output from said variable gain amplifier having a waveshape similar to that of said predetermined voice.

20. A breath pressure actuated electronic musical instrument as in claim 19 wherein said means for producing an internal control signal comprises an exponentiating pair of transistors producing an output current related exponentially to said tone signal, and wherein said means for sensing the temperature comprises a reference pair of transistors and a bridge circuit connected to the bases of said reference pair of transistors, said exponentiating pair and said reference pair including a common transistor, a common heat sink for said reference and exponentiating pairs of transistors, said tone signal being connected to said bridge circuit so that changes in said tone signal have no effect on the potential difference between the bases of said reference pair, first and second constant current generators for providing constant collector current in each of said reference pair, said reference signal being related to the potential difference between the bases of said reference pair whereby said reference signal is dependent on the temperature of said common heat sink only.

21. A breath pressure actuated electronic musical instrument as in claim 19 together with a key octave switch for providing an octave signal when actuated, said octave signal being connected to said digital to analog converter for changing said tone signal for shifting said tone frequency through an octave.

22. A breath pressure actuated electronic musical instrument as in claim 19 together with means for generating in harmonic frequency which is peculiar to said predetermined voice, said inharmonic frequency being coupled to said variable gain amplifier.

23. A breath pressure actuated electronic musical instrument as in claim 19 together with a low frequency noise source for providing a low frequency signal, said low frequency signal being coupled to said variable gain amplifier for producing breath tone affect in said instrument voice signal.

24. A breath pressure actuated electronic musical instrument as in claim 19 together with a key attack detector coupled to receive said tone signal and providing a key attack output for a change in said tone signal, a pressure attack detection circuit for receiving said pressure signal output and providing a pressure attack signal, and attack gate for receiving said key attack output and said pressure attack signal and providing an attack drive signal, and a voice attack network for receiving said attack drive signal and for providing predetermined voice attack output having a dwell time corresponding to the attack time peculiar to said predetermined voice, said predetermined voice attack output being coupled to said variable gain amplifier, whereby said instrument voice output includes attack characteristics peculiar to said predetermined voice.

25. A breath pressure actuated electronic musical instrument as in claim 24 together with means for adjusting said formant filter and means for adjusting said voice attack network, thereby providing said voice attack output and voice frequency corresponding to attack and steady state characteristics in said instrument voice signal respectively.

26. A breath pressure actuated electronic musical instrument as in claim 24 wherein said voice attack network includes programmed means for converting said attack drive signal to said predetermined voice attack output.

27. A breath pressure actuated electronic musical instrument as in claim 24 together with a portamento module for receiving said tone signal and for transmitting said tone signal to said exponential voltage controlled oscillator, a portamento control switch mounted on said instrument body accessible to the player's fingers for providing a portamento select signal when actuated, said portamento select signal being connected to disable said attack gate, whereby changes in said tone signal produce continuous tone frequency changes, and means for adjusting the rate of change of said tone signal.

28. A breath pressure actuated electronic musical instrument as in claim 19 together with a bite transducer mounted in said mouthpiece for engagement with the player's mouth and providing a bite signal in response to operation thereof by the player's mouth, an oscillator for receiving said bite signal and providing an oscillatory output related thereto, said oscillatory output being coupled to said variable gain amplifier for providing an oscillatory effect in said instrument voice signal.

29. A breath pressure actuated electronic musical instrument as in claim 28 together with means for adjusting rate of said oscillatory output, and means for adjusting excursion thereof.

30. A breath pressure actuated electronic musical instrument as in claim 28 together with an additional bite transducer mounted in said mouthpiece for engagement with the player's mouth and providing an additional bite signal in response to operation thereof by the player's mouth, an additional oscillator for receiving said additional bite signal and providing an input to the modulated output related thereto, said oscillatory output being a frequency modulated output, said input to modulated output being coupled to said variable gain amplifier whereby frequency and amplitude modulation effects are provided in said instrument voice signal.

31. A breath pressure actuated electronic musical instrument as in claim 19 together with a divider coupled to said tone frequency for providing a divided tone frequency, a doubling circuit for receiving said divided frequency and providing a doubling output which is one half said divided tone frequency, said doubling outward being out of coincidence with said divided tone frequency.

32. A breath pressure actuated electronic musical instrument as in claim 31 together with a tripling circuit for receiving said divided tone frequency and providing a tripling output having a frequency which is one fourth said divided tone frequency, said tripling output being out of coincidence with said divided tone frequency and said doubling output.

33. A breath pressure actuated electronic musical instrument as in claim 20 together with a low frequency noise source for providing a low frequency signal, said low frequency signal being coupled to said voice attack network for producing sub-audible noise in said instrument voice signal.

34. A breath pressure actuated electronic musical instrument for operation by a player utilizing finger pressure and breath pressure, comprising an instrument body, a mouth-piece attached to said instrument body adapted to be received in the player's mouth, a key panel attached to said instrument body, a plurality of keys mounted on said key panel which are accessible to the player's fingers, each of said keys producing a key pulse when pressed by the player's fingers, a key decoder for receiving said key pulses in predetermined combinations and for producing a digital output corresponding thereto, a digital to analog converter for said converting said digital output to a tone signal corresponding thereto, an exponential voltage controlled oscillator for receiving said tone signal and for producing a tone frequency which is exponentially related to said tone signal, means for sensing a temperature of said exponential voltage controlled oscillator and providing a reference signal related thereto, said reference signal being connected to said digital to analog converter for adjusting said tone signal to correct said tone frequencies for errors induced by temperature, a formant filter having an input coupled to the output of said exponential voltage controlled oscillator and providing a voice frequency output having characteristics of a predetermined voice, a pressure transducer mounted in said mouthpiece for providing a pressure signal, said pressure transducer being accessible to breath pressure from the player's mouth, and a variable gain amplifier coupled to the outputs of said formant filter and said pressure transducer, whereby simultaneous fingering of a predetermined combination of said plurality of keys and application of breath pressure by the player produces an instrument voice output from said variable gain amplifier having a waveshape similar to that of said predetermined voice at a predetermined pitch.

* * * * *